US009186894B2

(12) United States Patent
Mizukami et al.

(10) Patent No.: US 9,186,894 B2
(45) Date of Patent: Nov. 17, 2015

(54) DROPLET DISCHARGE HEAD, IMAGE FORMING APPARATUS, POLARIZATION PROCESSING METHOD OF ELECTROMECHANICAL TRANSDUCER, AND METHOD OF MANUFACTURING DROPLET DISCHARGE HEAD

(71) Applicants: Satoshi Mizukami, Kanagawa (JP); Naoya Kondo, Kanagawa (JP)

(72) Inventors: Satoshi Mizukami, Kanagawa (JP); Naoya Kondo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/659,958

(22) Filed: Mar. 17, 2015

(65) Prior Publication Data

US 2015/0266296 A1 Sep. 24, 2015

(30) Foreign Application Priority Data

Mar. 18, 2014 (JP) ..... 2014-055166

(51) Int. Cl.
*B41J 2/045* (2006.01)
*B41J 2/14* (2006.01)
*B41J 2/16* (2006.01)

(52) U.S. Cl.
CPC ..... *B41J 2/14201* (2013.01); *B41J 2/1607* (2013.01); *B41J 2002/14491* (2013.01)

(58) Field of Classification Search
CPC .. B41J 2/14201; B41J 2/14233; B41J 2/1601; B41J 2002/14491
See application file for complete search history.

(56) References Cited

U.S. PATENT DOCUMENTS

| | | | | |
|---|---|---|---|---|
| 2005/0068373 | A1* | 3/2005 | Yokouchi et al. | 347/56 |
| 2007/0090728 | A1* | 4/2007 | Matsuda et al. | 310/358 |
| 2012/0206540 | A1 | 8/2012 | Kato et al. | |

FOREIGN PATENT DOCUMENTS

| | | |
|---|---|---|
| JP | 2004-202849 | 7/2004 |
| JP | 2004-335708 | 11/2004 |
| JP | 2006-203190 | 8/2006 |
| JP | 2010-034154 | 2/2010 |
| JP | 2012-166393 | 9/2012 |

* cited by examiner

*Primary Examiner* — Juanita D Jackson
(74) *Attorney, Agent, or Firm* — Oblon, McClelland, Maier & Neustadt, L.L.P.

(57) ABSTRACT

A droplet discharge head includes a substrate, an electromechanical transducer, a first terminal electrode, a second terminal electrode, and a holding substrate. The holding substrate covers the electromechanical transducer. The holding substrate has a first opening to expose at least a part of the first terminal electrode and a second opening to expose at least a part of the second terminal electrode. The first and second openings are arranged in an area in which an amount of charges supplied by a discharge electrode becomes a threshold amount or more when, by corona or glow discharge generated by the discharge electrode arranged to face a surface of the holding substrate having the first and second openings, charges are supplied to the first and second terminal electrodes through the first and second openings to generate an electric field between first and second drive electrodes to perform polarization processing on the electromechanical transducer.

10 Claims, 11 Drawing Sheets

DROPLET DISCHARGE HEAD, IMAGE FORMING APPARATUS, POLARIZATION PROCESSING METHOD OF ELECTROMECHANICAL TRANSDUCER, AND METHOD OF MANUFACTURING DROPLET DISCHARGE HEAD

CROSS-REFERENCE TO RELATED APPLICATIONS

This patent application is based on and claims priority pursuant to 35 U.S.C. §119(a) to Japanese Patent Application No. 2014-055166, filed on Mar. 18, 2014, in the Japan Patent Office, the entire disclosure of which is hereby incorporated by reference herein.

BACKGROUND

1. Technical Field

Embodiments of this disclosure relate to a droplet discharge head to discharge droplets, an image forming apparatus such as a printer, a fax machine, and a copier including the droplet discharge head, a polarization processing method of an electromechanical transducer, and a method of manufacturing the droplet discharge head.

2. Description of the Related Art

Generally, an inkjet recording apparatus including a droplet discharge head to discharge, for example, droplets of ink (hereinafter, referred to as ink droplets) is known as a printer, a fax machine, a copier, a plotter, or an image forming apparatus obtained by combining functions of these devices. In the inkjet recording apparatus, ink droplets are adhered to a sheet medium by a droplet discharge head while the medium is conveyed and an image is formed.

As the droplet discharge head, a configuration that includes nozzles to discharge droplets of a liquid such as the ink, a liquid chamber (also referred to as a pressure chamber, a pressurization chamber, and a discharge chamber) that communicates with the nozzles and stores the liquid, and a piezoelectric element functioning as an electromechanical transducer that pressurizes the liquid in the liquid chamber is known. In the droplet discharge head, if a voltage is applied to the piezoelectric element, vibration is generated to deform a diaphragm forming a part of a wall of the liquid chamber, the liquid in the liquid chamber is pressurized by the deformation of the diaphragm, and the droplets can be discharged from the nozzles. As the droplet discharge head, a droplet discharge head using a piezoelectric actuator of a flexure vibration mode of the piezoelectric element is put into practical use.

A piezoelectric element used for the piezoelectric actuator of the flexure vibration mode includes a first drive electrode, a piezoelectric layer, and a second drive electrode. The diaphragm and the piezoelectric element are formed as a laminate on a substrate forming the liquid chamber and an insulating film, wiring lines to electrically connect the first and second drive electrodes to the outside, and a terminal electrode are formed on the piezoelectric element. In addition, a holding substrate covering the piezoelectric element not to disturb displacement is bonded to a surface of the substrate provided with the piezoelectric element.

In crystal of the piezoelectric layer configuring the piezoelectric element, a polarization direction becomes random in a state immediately after the piezoelectric element is manufactured, as illustrated in FIG. 19A. Then, the voltage application is repeated, so that the crystal of the piezoelectric layer becomes an aggregation of domains in which polarization directions are aligned, as illustrated in FIG. 19B. The polarization direction of the crystal of the piezoelectric layer is preferably aligned when the droplet discharge head starts to be used, to stabilize a polarization characteristic of the piezoelectric element and a characteristic of the droplet discharge head using the piezoelectric element. Methods are proposed of executing polarization processing to align the polarization direction of the piezoelectric element before the droplet discharge head starts to be used.

SUMMARY

In at least one aspect of this disclosure, there is provided a droplet discharge head including a substrate, an electromechanical transducer, a first terminal electrode, a second terminal electrode, and a holding substrate. The substrate includes a liquid chamber communicated with a nozzle to discharge droplets. The electromechanical transducer is provided on the substrate to pressurize a liquid in the liquid chamber. The electromechanical transducer includes a first drive electrode at a first side facing the substrate and a second drive electrode at a second side opposite to the first side. The first terminal electrode is connected to the first drive electrode. The second terminal electrode is connected to the second drive electrode. The holding substrate covers the electromechanical transducer to be displaceable. The holding substrate has a first opening to expose at least a part of the first terminal electrode and a second opening to expose at least a part of the second terminal electrode. The first opening and the second opening are arranged in an area in which an amount of charges supplied by a discharge electrode becomes a threshold amount or more when, by corona discharge or glow discharge generated by the discharge electrode arranged to face a surface of the holding substrate having the first opening and the second opening, charges are supplied to the first terminal electrode and the second terminal electrode through the first opening and the second opening to generate an electric field between the first drive electrode and the second drive electrode to perform polarization processing on the electromechanical transducer.

In at least one aspect of this disclosure, there is provided a polarization processing method of the electromechanical transducer in the droplet discharge head. The polarization processing method includes causing the holding substrate having the first opening to expose the first terminal electrode and the second opening to expose the second terminal electrode to face the discharge electrode with a void therebetween, after the holding substrate is provided; and executing discharge processing on at least the first opening and the second opening of the holding substrate such that charges of different amounts are applied to the first drive electrode and the second drive electrode through the first terminal electrode and the second terminal electrode by the discharge electrode.

In at least one aspect of this disclosure, there is provided a method of manufacturing the droplet discharge head. The method includes providing the electromechanical transducer on the substrate, forming the first terminal electrode and the second terminal electrode, providing the holding substrate, and executing a polarization processing. The polarization processing includes causing the holding substrate having the first opening to expose the first terminal electrode and the second opening to expose the second terminal electrode to face the discharge electrode with a void therebetween, after the holding substrate is provided, and executing discharge processing on at least the first opening and the second opening of the holding substrate such that charges of different amounts are applied to the first drive electrode and the second drive electrode through the first terminal electrode and the second terminal electrode by the discharge electrode.

In at least one aspect of this disclosure, there is provided an image forming apparatus comprising the droplet discharge head.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein:

FIG. 5B illustrates a cross-section 2 in FIG. 4;

Figure 1:
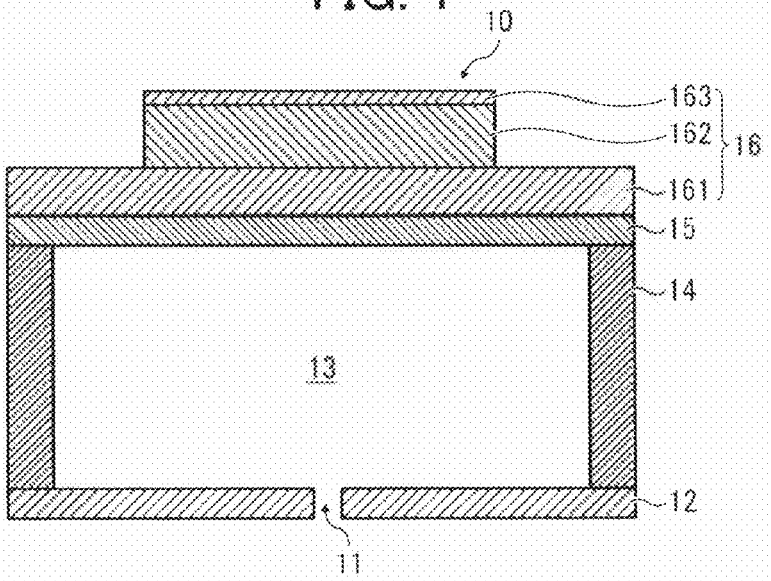
FIG. 1 is a schematic view of an example of a configuration of a droplet discharge unit to be a basic configuration portion of a droplet discharge head according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the medium used herein is also referred to as a "sheet." However, the medium is not limited to a specific material and a recording medium, a transfer material, and a recording sheet may be used. In addition, the image forming apparatus means an apparatus that applies droplets to a medium such as a sheet, thread, fiber, cloth, hides, metal, plastic, glass, wood, and ceramics and forms an image. In addition, the image formation means applying an image not having the meaning such as a pattern (discharging the droplets simply) as well as applying an image having the meaning such as a letter or a figure to the medium. In addition, the ink is used. However, the present disclosure is not limited to the ink and any material becoming a droplet at the time of being discharged may be used. The ink is used as a general term of liquids including a DNA sample, a resist, and a pattern material.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

As described above, methods are proposed of executing polarization processing to align the polarization direction of a piezoelectric element before a droplet discharge head starts to be used. For example, a method is proposed of manufacturing a piezoelectric element that executes a polarization step of applying a polarization voltage higher than a drive voltage at the time of practical use to the piezoelectric element and stabilizing a displacement amount of the piezoelectric element for the drive voltage. In addition, a method is proposed of arranging a discharge electrode to generate corona discharge to face a surface of a piezoelectric layer with a gap therebetween, supplying charges to the surface of the piezoelectric layer by the corona discharge, generating an electric field in the piezoelectric layer, and executing polarization processing.

However, such methods of executing the polarization step use a probe card to apply the polarization voltage or a driving assembly to drive the probe card in a state in which the probe card comes into direct contact with a drive electrode configuring the piezoelectric element or a terminal electrode connected to the drive electrode, thus resulting in an increased cost.

Figure 20:
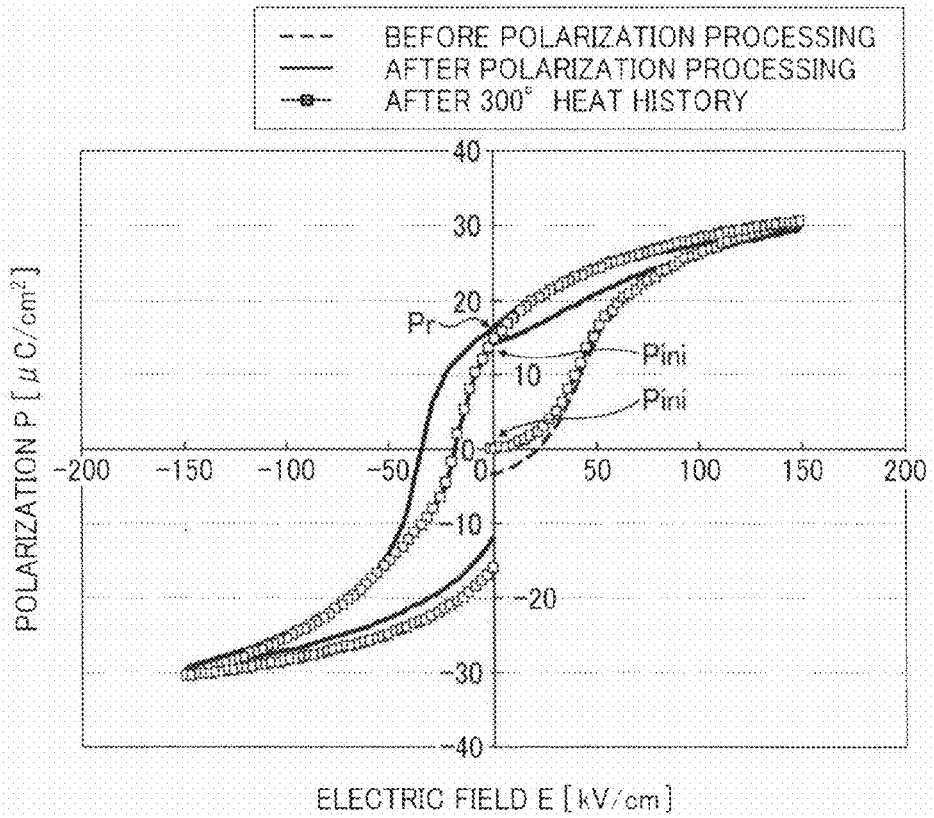
FIG. 20 is a graph illustrating P-E hysteresis loop characteristics of the piezoelectric element before the polarization processing, after the polarization processing, and after the heat history according to an embodiment of the present disclosure.

Alternatively, in a method, after the piezoelectric layer is formed, the polarization processing is executed in a state in which the surface of the piezoelectric layer is exposed, before the following steps (insulating film formation, wiring line and terminal electrode formation, and holding substrate bonding) are executed. In the piezoelectric element on which the polarization processing is executed, heat treatment is performed at the time of executing the insulating film formation, the wiring line and terminal electrode formation, and the holding substrate bonding to be the following steps. For this reason, the piezoelectric element is depolarized by an influence by a heat history in the following steps and a characteristic of electromechanical transduction ability may return to a state before the polarization processing, as illustrated in a P-E hysteresis characteristic of FIG. 20.

In light of the above-described situation, at least one embodiment of this disclosure provides a droplet discharge head that includes an electromechanical transducer having excellent polarization characteristics, an image forming apparatus including the droplet discharge head, a polarization processing method of the electromechanical transducer, and a method of manufacturing the droplet discharge head while reducing the manufacturing cost.

Hereinafter, embodiments to implement the present disclosure will be described with reference to the drawings.

First, a basic configuration of a droplet discharge head according to this embodiment will be described.

FIG. 1 is a schematic view of an example of a configuration of a droplet discharge unit 10 to be a basic configuration portion of a droplet discharge head according to an embodiment of the present disclosure.

In FIG. 1, the droplet discharge unit 10 includes a nozzle plate 12 that has a nozzle 11 to discharge droplets of a liquid such as ink and a liquid chamber substrate 14 (hereinafter, simply referred to as a "substrate") that forms a liquid chamber 13 communicating with the nozzle 11 and storing the liquid. In addition, a diaphragm 15 and a piezoelectric element 16 functioning as an electromechanical transducer to pressurize the liquid in the liquid chamber 13 through the diaphragm 15 are provided on the substrate 14. The piezoelectric element 16 is formed by stacking a common electrode (lower electrode) 161 to be a first drive electrode becoming the side of the substrate 14, a piezoelectric layer 162 functioning as an electromechanical transduction film and made of PZT to be described below, and an individual electrode (upper electrode) 163 to be a second drive electrode at the side of the piezoelectric layer 162 opposite to the side of the substrate 14. The common electrode 161 is connected to a common electrode pad to be a first terminal electrode for external connection to be described below. In addition, the individual electrode 163 is connected to an individual electrode pad to be a second terminal electrode for external connection to be described below.

In the droplet discharge unit 10 of FIG. 1, a drive voltage having predetermined frequency and amplitude is applied between the common electrode 161 and the individual electrode 163 of the piezoelectric element 16 through the common electrode pad and the individual electrode pad. The piezoelectric element 16 to which the drive voltage is applied vibrates to deform the diaphragm 15 existing between the substrate 14 and the piezoelectric element 16, the liquid in the liquid chamber 13 is pressurized by the deformation of the diaphragm 15, and the droplets are discharged from the nozzle 11.

Figure 2:
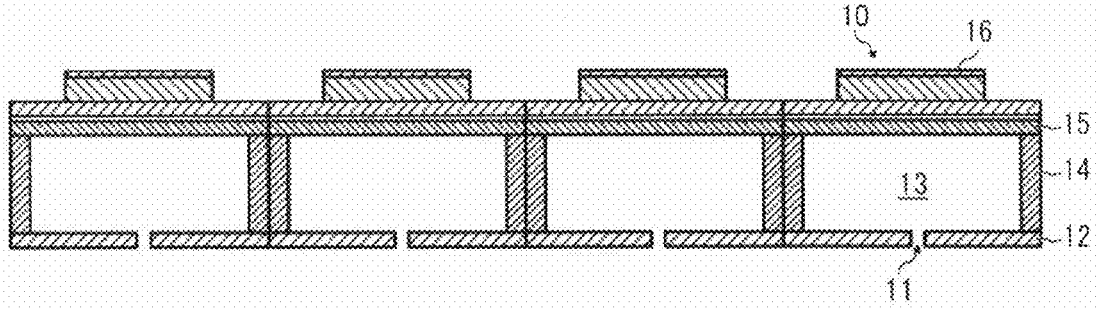
FIG. 2 is a cross-sectional view of a row in which a plurality of droplet discharge heads equal to the droplet discharge head of FIG. 1 are arranged according to an embodiment of the present disclosure.

In FIG. 1, the droplet discharge unit 10 including one nozzle 11 has been described. However, as illustrated in FIG. 2, an actual droplet discharge head has a configuration in which a plurality of droplet discharge units 10 are arranged in a row shape.

Figure 3:
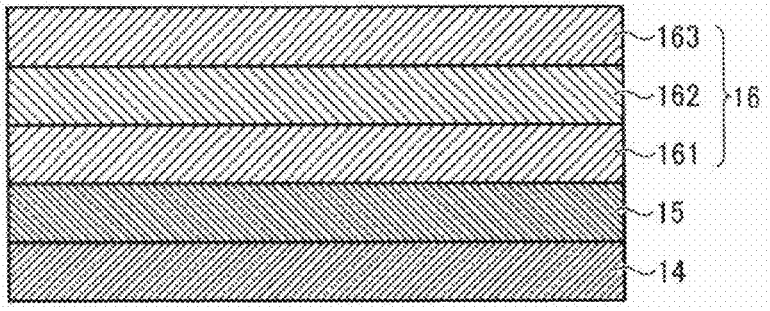
FIG. 3 is a cross-sectional view illustrating an example of a stacked structure of a diaphragm and a piezoelectric element on a substrate according to an embodiment of the present disclosure.
Figure 4:
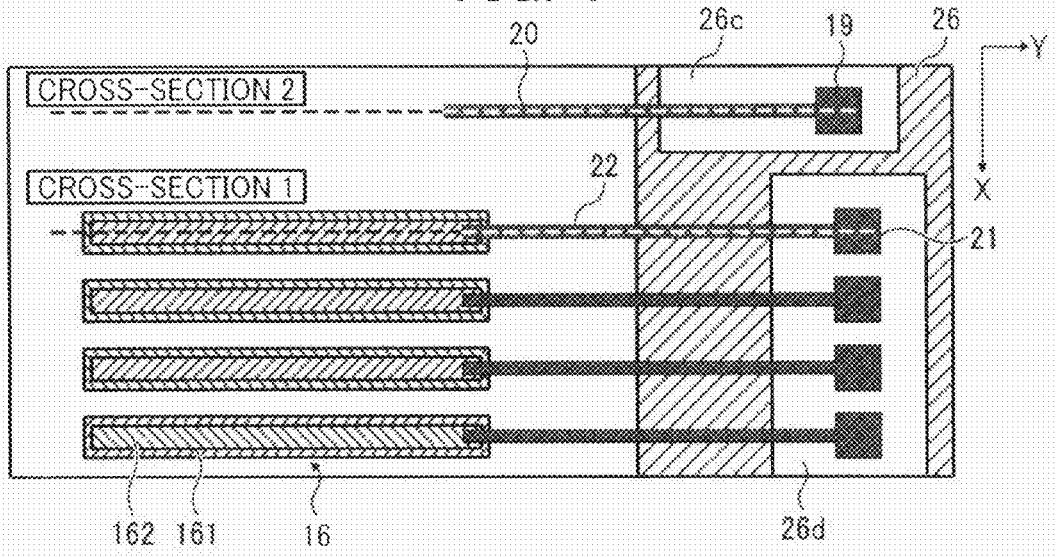
FIG. 4 is a plan view of a peripheral portion of the piezoelectric element of the droplet discharge head according to an embodiment of the present disclosure.
Figure 5A:
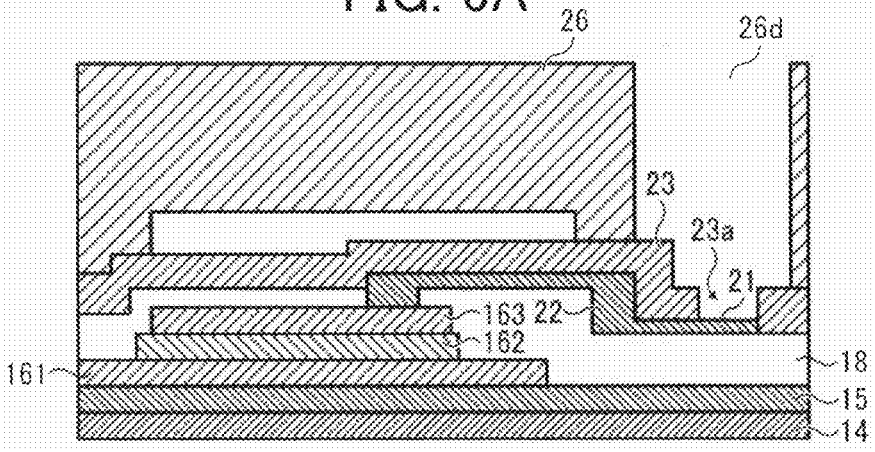
FIGS. 5A and 5B are cross-sectional views of the peripheral portion of the droplet discharge head according to an embodiment of the present disclosure and FIG. 5A illustrates a cross-section 1 in FIG. 4
Figure 5B:
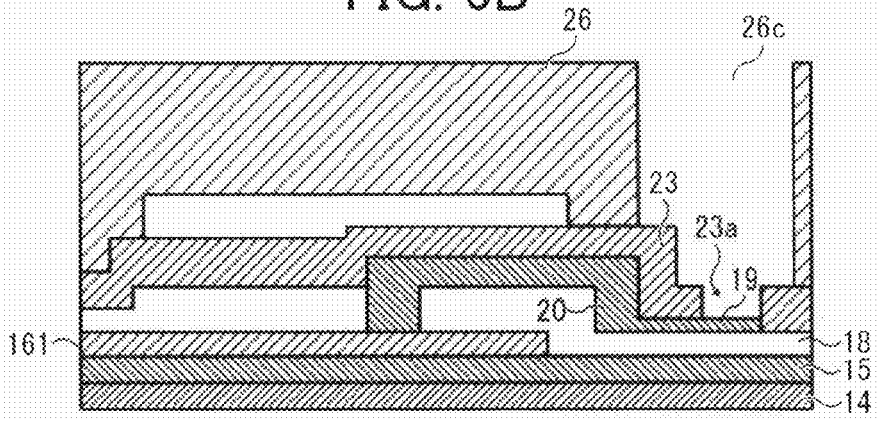

FIG. 3 is a cross-sectional view illustrating an example of a stacked structure of a diaphragm and a piezoelectric element on a substrate. FIG. 4 is a detailed plan view of a peripheral portion of the piezoelectric element 16. FIGS. 5A and 5B are detailed cross-sectional views of the peripheral portion of the piezoelectric element 16. FIG. 5A illustrates a cross-section 1 in FIG. 4. FIG. 5B illustrates a cross-section 2 in FIG. 4. In FIG. 4, a first insulation protective film 18 and a second insulation protective film 23 are not illustrated.

The diaphragm 15 formed by film formation is arranged between the common electrode 161 of the piezoelectric element 16 and the substrate 14. The piezoelectric element 16 is formed to contact the diaphragm 15. The common electrode 161, the piezoelectric layer 162, and the individual electrode 163 are stacked. After the individual electrode 163 is formed, the piezoelectric layer 162 and the individual electrode 163 are separated by etching. After the piezoelectric element 16 is formed, the first insulation protective film 18 is formed. In addition, a common electrode lead-out wiring line 20 that functions as a first wiring member to connect the common electrode 161 and a common electrode pad 19 to be a first terminal electrode is formed. In addition, an individual electrode lead-out wiring line 22 that functions as a first wiring member to connect the individual electrode 163 and an individual electrode pad 21 to be the second electrode terminal is formed. The first insulation protective film 18 electrically insulates the common electrode 161 and the individual electrode lead-out wiring line 22. In addition, the common electrode 161 and the common electrode lead-out wiring line 20 and the individual electrode 163 and the individual electrode lead-out wiring line 22 are connected by a contact hole 18*a* to be an opening formed in the first insulation protective film 18.

After the common electrode lead-out wiring line 20 and the individual electrode lead-out wiring line 22 are formed, the second insulation protective film 23 is formed to cover an entire portion of the common electrode lead-out wiring line 20 and the individual electrode lead-out wiring line 22. In the second insulation protective film 23, a plurality of openings 23*a* are provided and the common electrode pad 19 and the individual electrode pad 21 are exposed. A composite stacked substrate including the substrate 14, the piezoelectric element 16, and the various electrodes after the second insulation protective film 23 is formed is referred to as an actuator substrate.

The holding substrate 26 functioning as a structure provided to cover the piezoelectric element 16 in a state in which the holding substrate does not contact the piezoelectric element 16 with a void therebetween is bonded to the actuator substrate by an adhesive material. In the holding substrate 26, a recess portion 26*a* configured to cover the piezoelectric element 16 with the void therebetween is formed in a portion where the piezoelectric element 16 is positioned. In addition, the holding substrate 26 has an opening 26*d* in which a piezoelectric element drive IC functioning as an electric circuit element for drive to apply a pulse driving voltage having predetermined amplitude and frequency to the plurality of piezoelectric elements 16 is arranged. The individual electrode pad 21 is exposed to the opening 26*d* and the piezoelectric element drive IC is electrically connected to the individual electrode pad 21 by a bump electrode. Hereinafter, the opening 26*d* is referred to as an opening 26*d* for an individual pad. In addition, the holding substrate 26 has an opening (hereinafter, referred to as an opening for a common pad) 26*c* to which the common electrode pad 19 is exposed.

A liquid supply unit, a channel, and fluid resistance configuring the droplet discharge head are not described. However, incidental facilities that can be provided in the droplet discharge head can be provided naturally.

Next, polarization processing of the piezoelectric element 16 that is executed after the holding substrate 26 is bonded to the actuator substrate will be described.

In this embodiment, discharge processing of a corona discharge type or a glow discharge type is executed on the holding substrate 26 having the opening 26*c* for the common pad and the opening 26*d* for the individual pad to which the common electrode pad 19 and the individual electrode pad 21 are exposed, respectively. By the discharge processing, charges having predetermined polarities and different charge amounts are applied to the common electrode 161 and the individual electrode 163 of the piezoelectric element 16 through the common electrode pad 19 and the individual electrode pad 21. By the charge application, the polarization processing can be executed on the piezoelectric layer 162 interposed by the common electrode 161 and the individual electrode 163 of the piezoelectric element 16.

Figure 6:
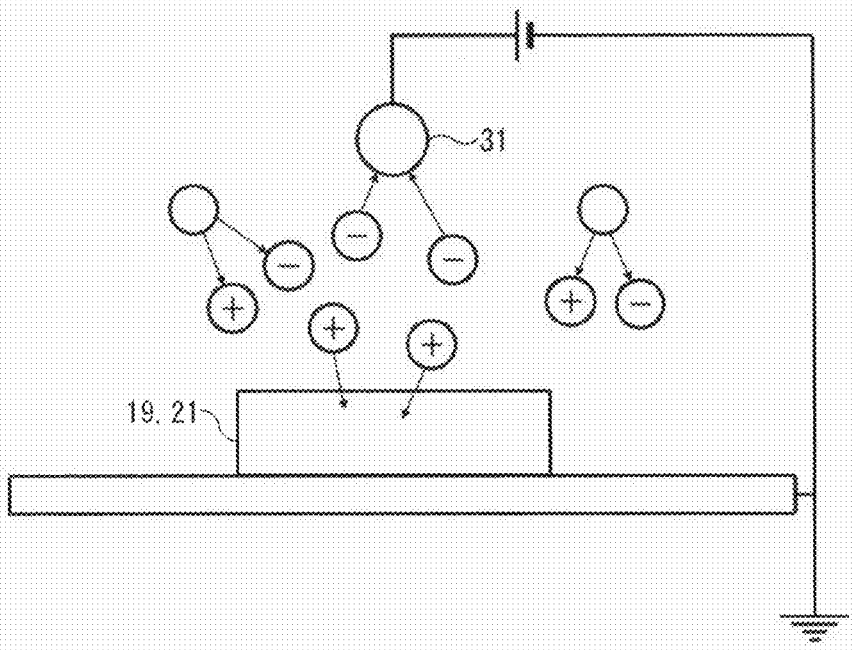
FIG. 6 is a diagram schematically illustrating an aspect where charges are injected into a common electrode pad and an individual electrode pad by discharge processing according to an embodiment of the present disclosure.
Figure 7:
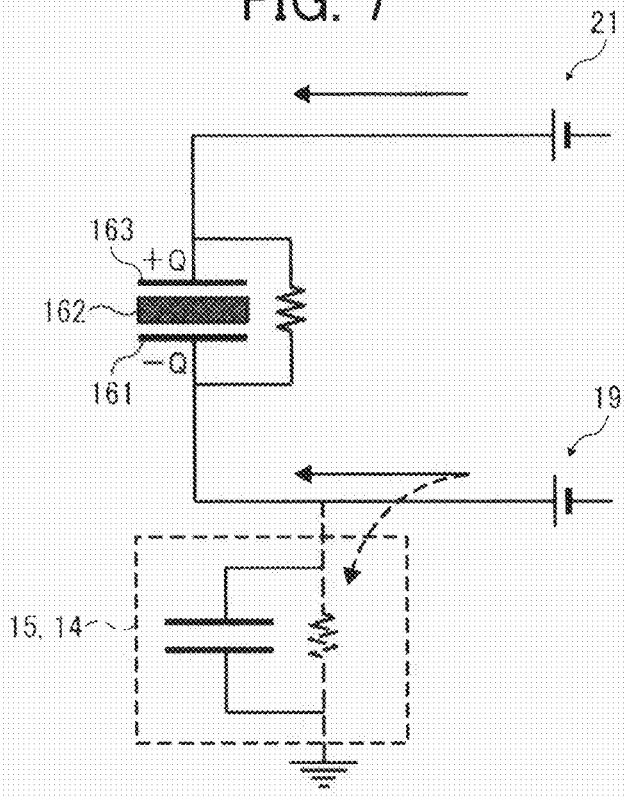
FIG. 7 is an equivalent circuit diagram illustrating the principle of polarization of the piezoelectric element by charge injection according to an embodiment of the present disclosure.

FIG. 6 is a diagram schematically illustrating an aspect where charges are injected into the common electrode pad 19 and the individual electrode pad 21 by the discharge processing. FIG. 7 is an equivalent circuit diagram illustrating the principle of polarization of the piezoelectric element 16 by charge injection.

In FIG. 6, if corona discharge is generated using a corona wire electrode 31, atmospheric molecules are ionized and positive ions and negative ions are generated. Among the generated ions, the positive ions flow to the common electrode 161 and the individual electrode 163 of the piezoelectric element 16 through the common electrode pad 19 and the individual electrode pad 21 and are accumulated in these electrodes.

Here, as illustrated in FIG. 7, the positive ions generated by the corona discharge are supplied to both the common electrode pad 19 and the individual electrode pad 21. The charges supplied to the individual electrode pad 21 flow to the individual electrode 163 and are accumulated in the individual electrode. Meanwhile, some of the charges supplied to the common electrode pad 19 flow to a GND through the diaphragm 15 and the substrate 14 at the lower side of the common electrode 161 and the remaining charges are accumulated in the common electrode 161. For this reason, the charges accumulated in the individual electrode 163 through the individual electrode pad 21 and the charges accumulated in the common electrode 161 through the common electrode pad 19 become charges having predetermined polarities and different charge amounts. Thereby, a potential difference is generated between the individual electrode 163 and the common electrode 161 and the piezoelectric layer 162 is subjected to the polarization processing.

Here, a state of the polarization processing of the piezoelectric layer 162 can be determined from a P-E hysteresis loop characteristic of the piezoelectric element.

Figure 8A:
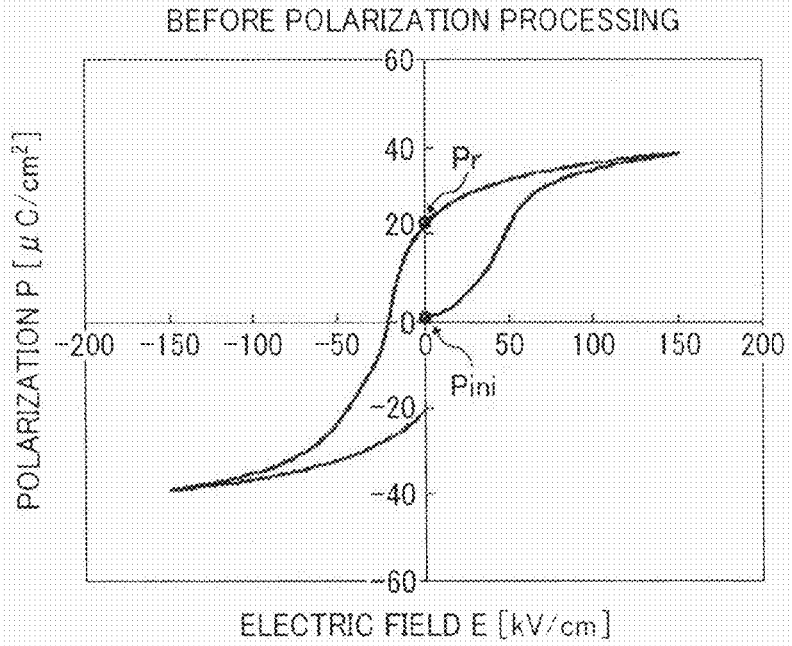
FIGS. 8A and 8B are characteristic diagrams illustrating a measurement example of a P-E hysteresis loop characteristic of the piezoelectric element before and after the polarization processing, respectively according to an embodiment of the present disclosure.
Figure 8B:
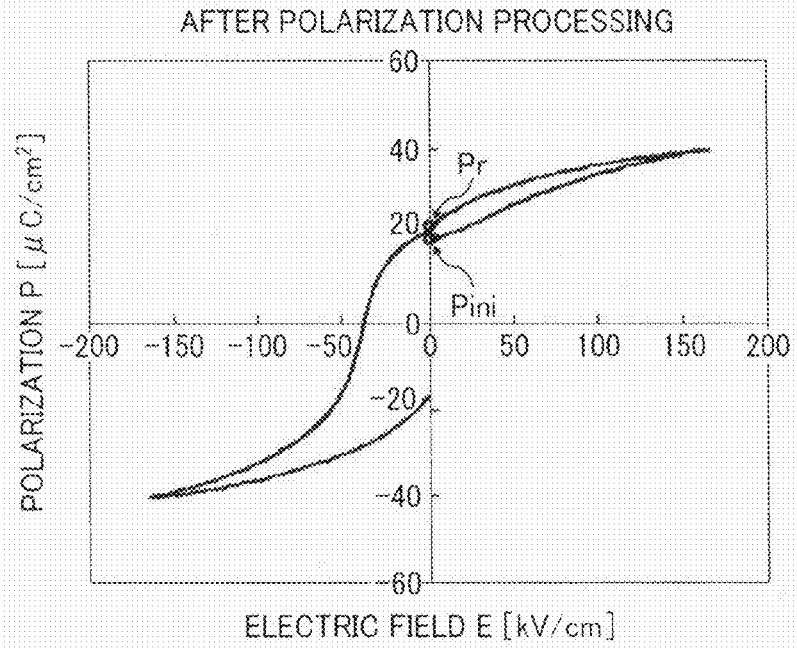

FIGS. 8A and 8B are graphs illustrating a measurement example of a P-E hysteresis loop characteristic of the piezoelectric element before and after the polarization processing, respectively. As illustrated in FIGS. 8A and 8B, a hysteresis loop is measured over field strength of ±150 [kV/cm]. When polarization at 0 [kV/cm] is set to Pini and the polarization at 0 [kV/cm] when a voltage of +150 [kV/cm] returns to 0 [kV/cm] after the voltage of +150 [kV/cm] is applied is set to Pr, a value of Pr−Pini is defined as a polarization amount difference. From the polarization amount difference (Pr−Pini), a quality of a polarization state can be determined. For example, the polarization amount difference (Pr−Pini) preferably becomes 10 [$\mu C/cm^2$] or less. As illustrated in FIG. 8B, the polarization amount difference (Pr−Pini) more preferably becomes 5 [$\mu C/cm^2$] or less. Meanwhile, when the value of the polarization amount difference (Pr−Pini) is larger than 10 [$\mu C/cm^2$], as illustrated in FIG. 8A, for displacement deterioration after continuous drive as a piezoelectric actuator composed of the piezoelectric element, a sufficient characteristic is not obtained.

Next, an example of a configuration of a polarization processing apparatus that executes the polarization processing will be described using FIGS. 9 to 11B.

Figure 9:
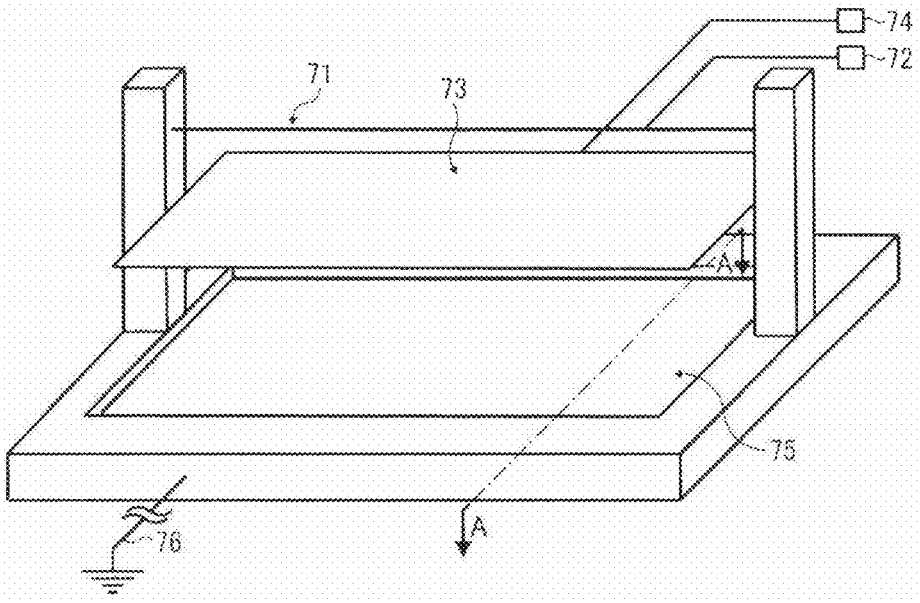
FIG. 9 is an external view of a polarization processing apparatus according to an embodiment of the present disclosure.
Figure 10:
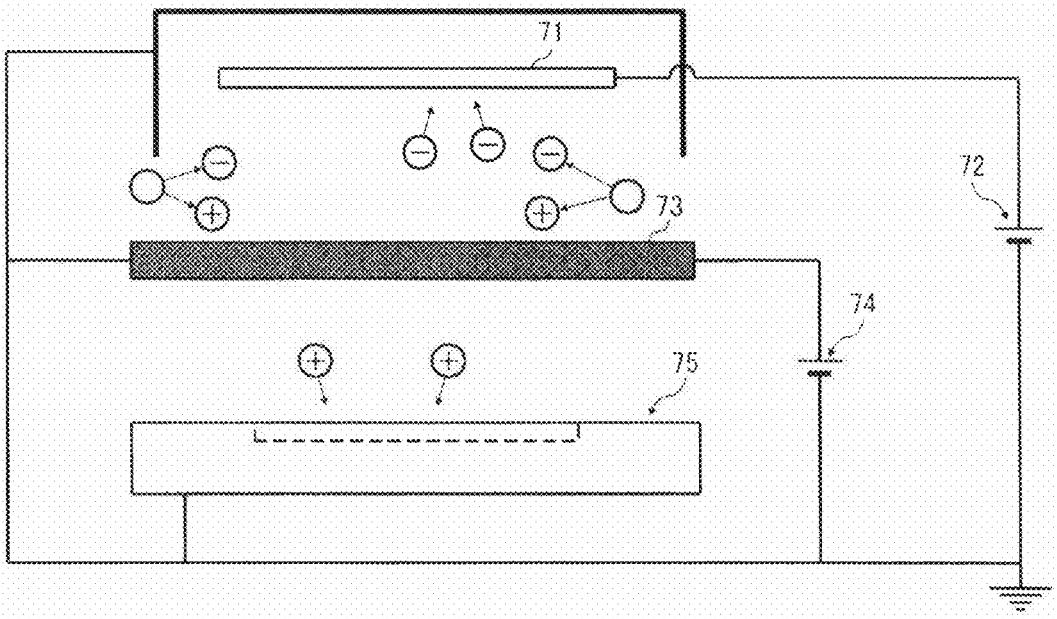
FIG. 10 is a diagram illustrating a wiring line of the polarization processing apparatus according to an embodiment of the present disclosure.
Figure 11A:
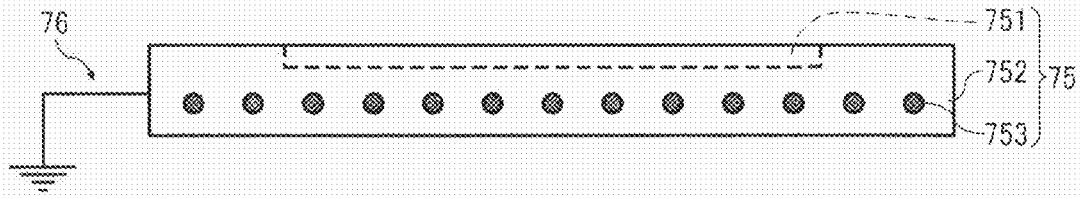
FIGS. 11A and 11B are cross-sectional views taken along the line A-A' in FIG. 9 according to an embodiment of the present disclosure.
Figure 11B:
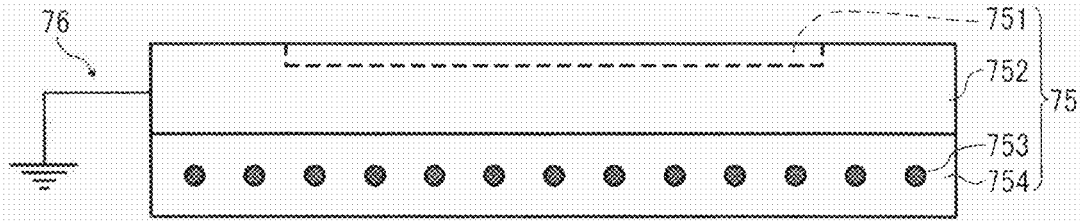

FIG. 9 is an external view of the polarization processing apparatus, FIG. 10 is a diagram illustrating a wiring line of the polarization processing apparatus, and FIGS. 11*a* and 11B are cross-sectional views taken along the line A-A' in FIG. 9.

The polarization processing apparatus includes a corona electrode 71 and a grid electrode 73 and the corona electrode 71 and the grid electrode 73 are connected to a power supply 72 for a corona electrode and a power supply 74 for a grid electrode, respectively. At this time, as illustrated in FIG. 10, other terminal that is not connected to individual electrodes of the power supply 72 for the corona electrode and the power supply 74 for the grid electrode can be connected to a place where a sample of a sample stage 75 is arranged. As described below, when ground wire 76 is connected to the sample stage 75, the terminal can be connected to the ground wire 76.

The configuration of the corona electrode 71 is not limited in particular. For example, the corona electrode 71 can be configured to have a wire shape as illustrated in the drawings and can be configured using various conductive materials.

The grid electrode 73 is arranged between the corona electrode 71 and the sample stage 75. The configuration of the grid electrode 73 is not limited in particular. However, the grid electrode 73 is preferably configured to efficiently emit ions or charges generated by the corona discharge to the lower sample stage 75, when mesh processing is executed and a high voltage is applied to the corona electrode 71.

In addition, a heating assembly is attached to the sample stage 75 to heat the piezoelectric element 16. A specific mechanism of the heating assembly to heat the piezoelectric element 16 is not limited in particular and can be configured to heat the piezoelectric element 16 using various heaters or lamps. In addition, the heating assembly can be arranged in the sample stage 75 and can be arranged to heat the piezoelectric element 16 from the outside of the sample stage 75. The heating assembly is preferably arranged in the sample stage 75 to avoid interference with the electrodes.

A configuration example of the case in which the heating assembly is arranged in the sample stage 75 will be described using FIGS. 11A and 11B. However, the present disclosure is not limited to the following configuration as described above.

As illustrated in FIG. 11A, the sample stage 75 can have a configuration in which a groove 751 for sample holding formed according to a sample shape and a heating assembly 753 made of heating wire are provided in a sample holder 752. In addition, the sample stage 75 can have a configuration in which ground wire 76 is provided in the sample stage, as described below. The above configuration is preferably used because it is easy to heat a sample uniformly by the heating assembly 753 particularly. Particularly, from the viewpoint of heating the sample uniformly, the sample holder 752 is preferably made of a metal. For example, stainless steel and inconel is more preferably used. Particularly, inconel is further preferably used from the viewpoint of heating the sample uniformly.

As another configuration example, as illustrated in FIG. 11B, the sample stage 75 can be divided into the sample holder 752 and a heating assembly holder 754. In this case, the groove 751 for the sample holding can be formed in the sample holder 752. In addition, the heating assembly 753 made of the heating wire can be provided in the heating assembly holder 754. In this case, the sample holder 752 is preferably made of a metal to increase heat conductivity. For example, stainless steel and inconel is more preferably used. Particularly, inconel is further preferably used from the viewpoint of heating the sample uniformly. In the configuration illustrated in FIG. 11B, the sample holder 752 and the heating assembly holder 754 can be simply stacked and can be fixed by an adhesive material or a fixture.

In FIGS. 11A and 11B, the configuration in which the groove 751 for the sample holding is provided is illustrated. However, the sample may be arranged in any place on the sample holder 752, without providing the groove.

A maximum heating temperature of the heating assembly is not limited in particular and the piezoelectric element 16 may be heated at a predetermined temperature according to a Curie temperature of the piezoelectric layer 162 of the manufactured piezoelectric element 16. The piezoelectric element 16 is preferably heated at a maximum of 350° C. to correspond to various piezoelectric elements.

In addition, the sample stage 75 to arrange the sample such that it is easy for the charges to flow to the sample arranged on the sample stage is preferably connected to a ground. That is, the ground wire 76 is preferably connected to the sample stage 75.

The magnitude of the voltage applied to the corona electrode or the grid electrode and the distance between the sample and each electrode are not limited in particular and the intensity of the corona discharge can be adjusted by adjusting the magnitude and the distance such that the polarization processing can be sufficiently executed.

Because an area where the charges are emitted (supplied) to the sample at the time of the corona discharge is limited in the sample stage 75, a moving assembly that can move the sample to process the entire sample is added. A moving unit is not limited in particular.

In addition, a charge amount Q necessary when the polarization processing is executed is not limited in particular. However, a charge amount of $1.0\times10^{-8}$[C] or more is preferably accumulated in the electromechanical transducer and a charge amount of $4.0\times10^{-8}$[C] or more is further preferably accumulated in the electromechanical transducer. A charge amount in the related range is accumulated in the piezoelectric element 16, so that superior polarization processing can be more surely executed to have the polarization amount difference.

Next, a characteristic portion of the droplet discharge head according to this embodiment will be described.

In the polarization processing method described in JP-2006-203190-A, it is necessary to execute the polarization processing in a state in which the surface of the piezoelectric layer 162 is exposed. For this reason, steps of forming the first insulation protective film 18, the common electrode lead-out wiring line 20, the individual electrode lead-out wiring line 22, and the second insulation protective film 23, including heat treatment of a high temperature more than 300° C., are executed on the piezoelectric element on which the polarization processing has been executed. In addition, a step of bonding the holding substrate 26 by the adhesive material, including the heat treatment of 100 to 200° C., is executed. For this reason, the piezoelectric element is depolarized by an influence by a heat history in the steps after the polarization processing and a characteristic of electromechanical transduction ability may return to a state before the polarization processing.

In this embodiment, the polarization processing is executed at a step close to a final step after the holding substrate 26 is bonded to the actuator substrate, so that the depolarization by the influence of the heat history by the following steps can be prevented. The polarization processing is executed in the following order. That is, after the holding substrate 26 is bonded to the actuator substrate, the corona electrode 71 of the polarization apparatus is made to face the surface of the holding substrate 26 provided with the opening 26*c* for the common pad and the opening 26*d* for the individual pad. In addition, the discharge processing is executed on the opening 26*c* for the common pad to which the common electrode pad 19 is exposed and the opening 26*d* for the individual pad to which the individual electrode pad 21 is exposed, by the corona electrode 71, and the charges are supplied to the common electrode pad 19 and the individual electrode pad 21.

In the polarization processing, the charges are supplied to the common electrode pad 19 and the individual electrode pad 21 through the opening 26*c* for the common pad and the opening 26*d* for the individual pad, by the corona discharge generated by the corona electrode 71. Meanwhile, in the corona discharge, the intensity of the discharge increases when a distance with the corona electrode 71 decreases and the intensity of the discharge decreases when the distance with the corona electrode 71 increases. For this reason, an amount of charges supplied to the common electrode pad 19 and the individual electrode pad 21 changes according to an arrangement of the opening 26*c* for the common pad and the opening 26*d* for the individual pad for the corona electrode 71. That is, when the polarization processing is executed after bonding of the holding substrate 26, the arrangement of the opening 26*c* for the common pad and the opening 26*d* for the individual pad may affect the polarization processing.

In the droplet discharge head according to this embodiment, the opening 26*c* for the common pad and the opening 26*d* for the individual pad are arranged to be adjacent to each other to become areas where an amount of charges supplied by the corona electrode 71 becomes a predetermined amount or more. Thereby, charges of an amount equal to or larger than a predetermined amount can be supplied to the opening 26*c* for the common pad and the opening 26*d* for the individual pad and the superior polarization processing is enabled. Meanwhile, if the opening 26*c* for the common pad and the opening 26*d* for the individual pad are arranged to be apart from each other, the sufficient charges cannot be supplied to the opening 26*c* for the common pad or the opening 26*d* for the individual pad and it becomes difficult for the polarization to advance.

Specifically, in the droplet discharge head according to this embodiment, the arrangement of the opening 26*c* for the common pad and the opening 26*d* for the individual pad and the arrangement of the common electrode pad 19 and the individual electrode pad 21 exposed from the individual openings are as follows.

Figure 12:
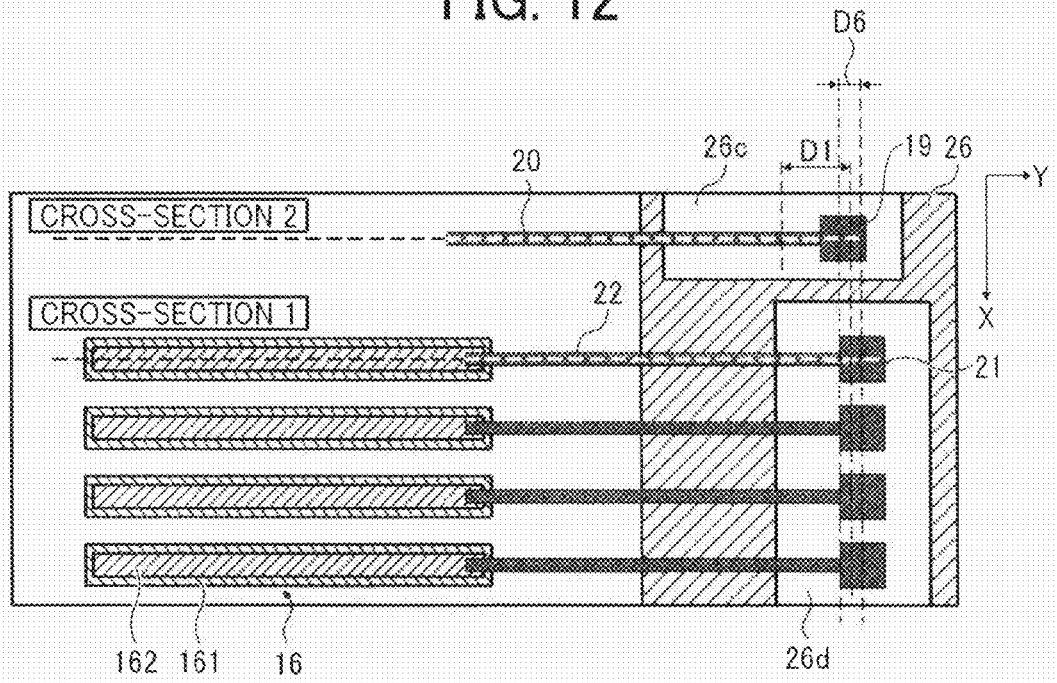
FIG. 12 is a (first) diagram illustrating an arrangement of an opening for a common pad and an opening for an individual pad and an arrangement of a common electrode pad and an individual electrode pad according to an embodiment of the present disclosure.
Figure 13:
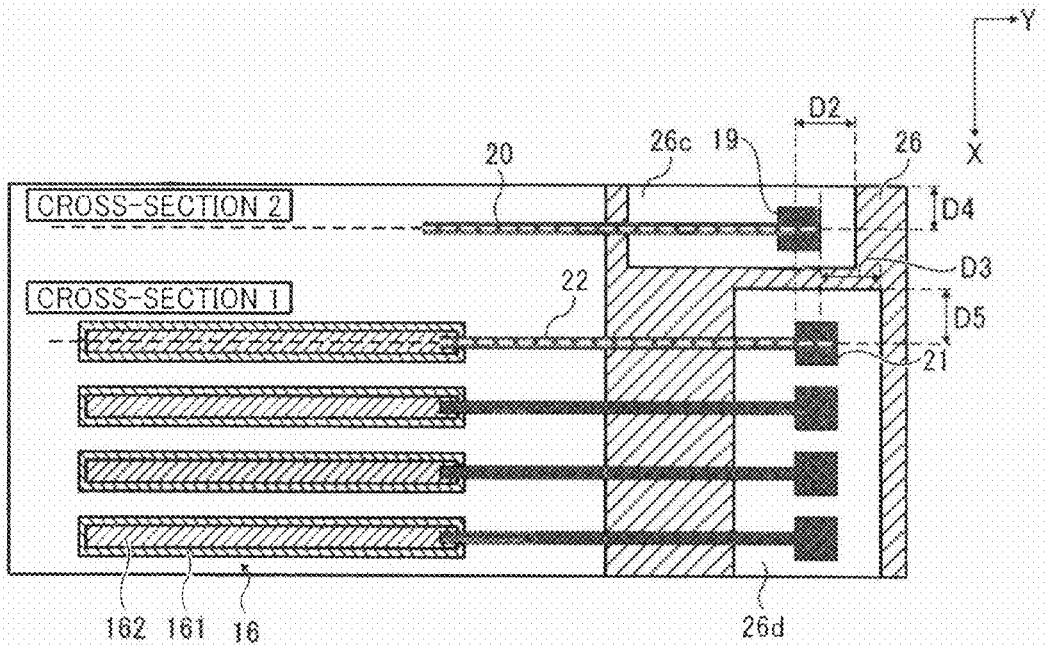
FIG. 13 is a (second) diagram illustrating an arrangement of an opening for a common pad and an opening for an individual pad and an arrangement of a common electrode pad and an individual electrode pad according to an embodiment of the present disclosure.

FIGS. 12 and 13 are diagrams illustrating the arrangement of the opening 26*c* for the common pad and the opening 26*d* for the individual pad and the arrangement of the common electrode pad 19 and the individual electrode pad 21 in this embodiment. In FIGS. 12 and 13, a row direction in which the plurality of individual electrode pads 21 are arranged is referred to as an X direction and a direction perpendicular to the row direction is referred to as a Y direction.

A distance (hereinafter, referred to as a distance D1) of the Y direction from the center of the opening 26*c* for the common pad to the center of the opening 26*d* for the individual pad, which is illustrated in FIG. 12, is 3000 μm or less and is preferably 1000 μm or less. If the distance D1 is beyond the range, it is difficult to supply the charges of the predetermined amount generated by the corona electrode 71 to the opening 26*c* for the common pad or the opening 26*d* for the individual pad.

In addition, a distance (hereinafter, referred to as a distance D6) of the Y direction from the center of the common electrode pad 19 exposed from the opening 26*c* for the common pad to the center of the individual electrode pad 21 exposed from the opening 26*d* for the individual pad is 3000 μm or less and is preferably 1000 μm or less. If the distance D6 is beyond the range, it is difficult to supply the charges to the common electrode pad 19 or the individual electrode pad 21, even though the charges of the predetermined amount or more are supplied into the common electrode pad 19 or the individual electrode pad 21 through the opening 26*c* for the common pad or the opening 26*d* for the individual pad.

The opening 26*c* for the common pad and the opening 26*d* for the individual pad may expose a part of the common electrode pad 19 and the individual electrode pad 21, instead of exposing the entire portion thereof, as illustrated in FIGS. 12 and 13. Even in a shape in which the part is exposed, the distance D1 is set to 3000 μm or less and the distance D6 is set to 3000 μm or less, so that the charges necessary for the polarization processing can be supplied to the common electrode pad 19 and the individual electrode pad 21.

Figure 14:
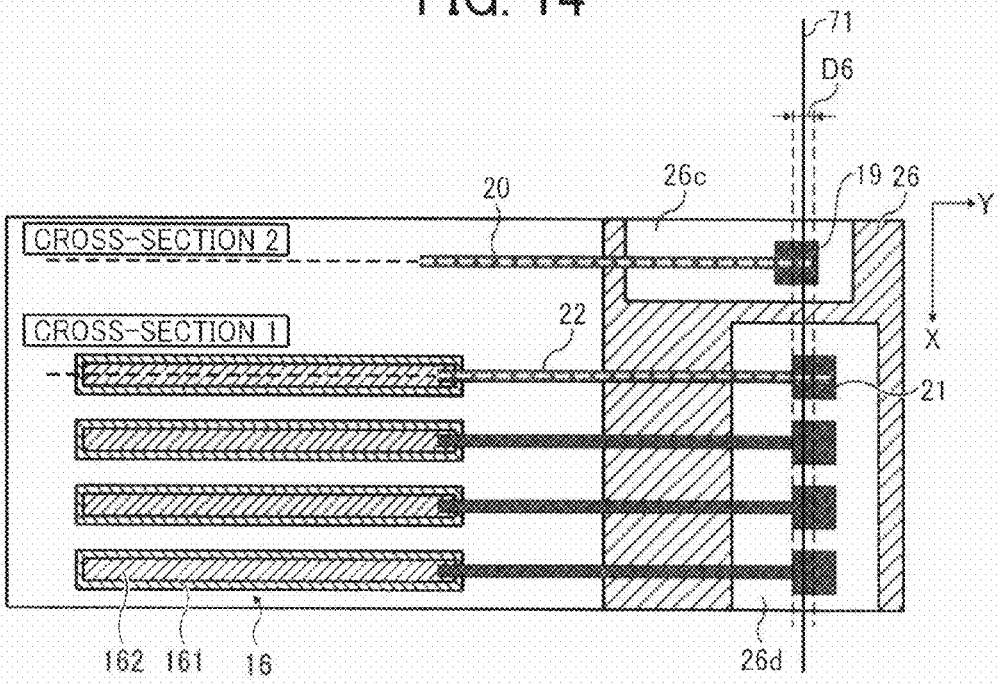
FIG. 14 is a diagram illustrating an arrangement of a corona electrode of a polarization apparatus according to an embodiment of the present disclosure.

FIG. 14 is a diagram illustrating an arrangement of the corona electrode of the polarization apparatus in this embodiment. The corona electrode 71 is arranged to be parallel to the X direction at an intermediate position of the Y direction of the center of the common electrode pad 19 and the center of the individual electrode pad 21, so that the charges are collectively supplied to the plurality of individual electrode pads 21 and the common electrode pad 19 and the polarization processing is executed. From experiments to be described below, it is confirmed that the superior polarization processing is executed when the distance D1 is 3000 μm or less and the distance D6 is 3000 μm or less, but it becomes difficult for the polarization to advance, when the distances D1 and D6 are beyond the range.

As illustrated in FIG. 13, a distance (hereinafter, referred to as a distance D2) of the Y direction from the center of the common electrode pad 19 to an end of the opening 26*c* for the common pad is 250 μm or more and is preferably 400 μm or more. A distance (hereinafter, referred to as a distance D4) of the X direction from the center of the common electrode pad 19 to the end of the opening 26*c* for the common pad is 250 μm or more and is preferably 400 μm or more. That is, the distance of the horizontal direction from the center of the common electrode pad 19 to the end of the opening 26*c* for the common pad is 250 μm or more and is more preferably 400 μm or more. If the center of the common electrode pad 19 is excessively close to the end of the opening 26*c* for the common pad, the amount of charges supplied to the common electrode pad 19 decreases.

A distance (hereinafter, referred to as a distance D3) of the Y direction from the center of the individual electrode pad 21 to the end of the opening 26*d* for the individual pad is 250 μm or more and is preferably 400 μm or more. In addition, a distance (hereinafter, referred to as a distance D5) of the X direction from the center of the individual electrode pad 21 to the end of the opening 26*d* for the individual pad is 250 μm or more and is preferably 400 μm or more. That is, the distance of the horizontal direction from the center of the individual electrode pad 21 to the end of the opening 26*d* for the individual pad is 250 μm or more and is preferably 400 μm or more. If the center of the individual electrode pad 21 is excessively close to the end of the opening 26*d* for the individual pad, the amount of charges supplied to the individual electrode pad 21 decreases.

That is, the distance from the center of the common electrode pad 19 to the end of the opening 26*c* for the common pad and the distance from the center of the individual electrode pad 21 to the end of the opening 26*d* for the individual pad are set in the range, so that it is easy to supply the charges to the common electrode pad 19 and the individual electrode pad 21. For this reason, it becomes for the polarization processing to advance, as illustrated in experiments described below.

The area of the common electrode pad 19 or the area of the opening 26*c* for the common pad is not defined in particular. However, the area of the opening 26*c* for the common pad is preferably larger than the area of the common electrode pad 19. Even though the above relation is collapsed, a problem in that the polarization does not advance at all does not occur. However, it is confirmed that it is preferable to increase the area of the opening 26*c* for the common pad to relatively facilitate the polarization.

In addition, the area of the individual electrode pad 21 or the area of the opening 26*d* for the individual pad is not defined in particular. However, the area of the opening 26*d* for the individual pad is preferably larger than the area of the individual electrode pad 21. Even though the above relation is collapsed, a problem in that the polarization does not advance at all does not occur. However, it is confirmed that it is preferable to increase the area of the opening 26*d* for the individual pad to relatively facilitate the polarization.

In addition, the opening 26*d* for the individual pad does not need to be provided in each of the plurality of individual electrode pads 21. As illustrated in FIGS. 12 to 14, the opening 26*d* for the individual pad is preferably opened continuously to the plurality of individual electrode pads 21. In a configuration in which the opening 26*d* for the individual pad is provided in each of the plurality of individual electrode pads 21, it is confirmed that polarization efficiency is deteriorated.

Figure 15:
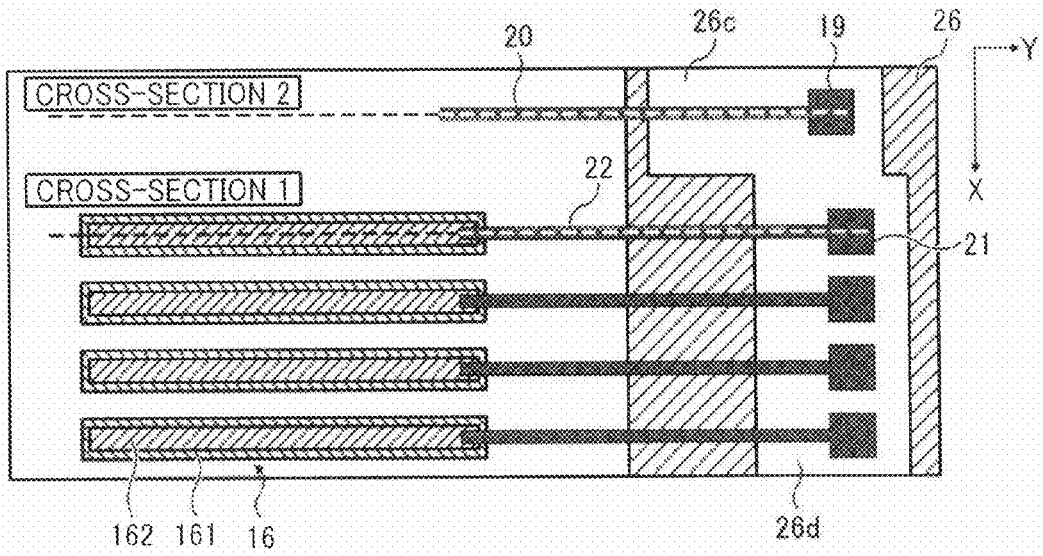
FIG. 15 is a diagram illustrating another arrangement example of an opening for a common pad and an opening for an individual pad in a holding substrate according to an embodiment of the present disclosure.

As illustrated in FIG. 15, the opening 26*c* for the common pad and the opening 26*d* for the individual pad may be opened continuously.

Hereinafter, a material and a method to form the droplet discharge head according to this embodiment will be specifically described.

[Substrate]

A silicon single crystal substrate is preferably used as the substrate 14 and a thickness of the substrate 14 is preferably in a range from 100 μm to 600 μm in general. As plane orientations, three kinds of (100), (110), and (111) are known. However, (100) and (111) are generally used widely in the semiconductor industry. In this configuration example, a single crystal substrate having a plane orientation of (100) is mainly used. In addition, when the liquid chamber (pressure chamber) 13 illustrated in FIG. 1 is manufactured, the silicon single crystal substrate is processed using etching. In this case, anisotropic etching is generally used as an etching method. The anisotropic etching uses the property that an etching rate is different for each plane orientation of a crystal structure. For example, in the anisotropic etching in which the substrate is immersed in an alkaline solution such as KOH, an etching rate of a (111) plane becomes about 1/400 of an etching rate of a (100) plane. Therefore, a structure having an inclination of about 54° can be manufactured in the plane orientation (100), but a deep groove can be formed in the plane orientation (110). For this reason, an array density can be increased while rigidity is maintained. In this configuration example, the single crystal substrate having the plane orientation of (110) can be used. In this case, however, because $SiO_2$ to be a mask material may also be etched, the single crystal substrate having the plane orientation of (110) is used in consideration of the above point.

[Diaphragm]

As illustrated in FIG. 1, the diaphragm 15 below the piezoelectric element 16 is deformed by force generated by the piezoelectric element 16 functioning as the electromechanical transducer and discharges droplets of a liquid such as the ink of the liquid chamber (pressure chamber) 13. For this reason, a component having predetermined strength is preferably used as the diaphragm 15. As the material of the diaphragm 15, materials manufactured using Si, $SiO_2$, and $Si_3N_4$ and a chemical vapor deposition (CVD) method are exemplified. In addition, materials of which linear expansion coefficients are close to linear expansion coefficients of the common electrode 161 and the piezoelectric layer 162 illustrated in FIG. 1 are preferably selected as materials of the diaphragm 15. Particularly, PZT to be described below is often used as the general material of the piezoelectric layer. Therefore, materials having linear expansion coefficients in a range from $5\times10^{-6}$ [1/K] to $10\times10^{-6}$ [1/K] close to $8\times10^{-6}$ [1/K] to be a linear expansion coefficient of the PZT are preferably used as the materials of the diaphragm 15. In addition, materials having linear expansion coefficients in a range from $7\times10^{-6}$ [1/K] to $9\times10^{-6}$ [1/K] are more preferably used as the materials of the diaphragm 15. As specific materials of the diaphragm 15, aluminum oxide, zirconium oxide, iridium oxide, ruthenium oxide, tantalum oxide, hafnium oxide, osmium oxide, rhenium oxide, rhodium oxide, palladium oxide, and compounds thereof can be exemplified. A film of these materials is formed by a spin coater using a sputtering method or a sol-gel method. A film thickness of the diaphragm 15 is preferably in a range from 0.1 μm to 10 μm and is more preferably in a range from 0.5 μm to 3 μm. If the film thickness is smaller than a film thickness in the above range, it becomes difficult to process the liquid chamber (pressure chamber) 13 illustrated in FIG. 1. If the film thickness is larger than the film thickness in the above range, it becomes difficult to deform the diaphragm 15 and the discharge of the droplets such as the ink droplets becomes unstable.

[Common Electrode (Lower Electrode)]

The common electrode (lower electrode) 161 is preferably formed using a metal or the metal and oxide. Here, all materials are contrived such that removal is suppressed from occurring by insertion of an adhesion layer between the diaphragm 15 and the metal film forming the common electrode 161. Details of a metal electrode film and an oxide electrode film including the adhesion layer are described below.

[Adhesion Layer]

For example, an adhesion layer is formed as follows. After a titanium film is formed by sputtering Ti, the formed titanium film is thermally oxidized using a rapid thermal annealing (RTA) device and a titanium oxide film is formed. Conditions of thermal oxidation are, for example, a temperature in a range from 650 [° C.] to 800 [° C.], a processing time in a range from 1 [min.] to 30 [min.], and an $O_2$ atmosphere. A reactive sputtering may be used when the titanium oxide film is formed. However, a thermal oxidation method with a high temperature using the titanium film is preferable. When the titanium oxide film is formed using the reactive sputtering, it is necessary to heat the silicon substrate at a high temperature. For this reason, a special sputtering chamber configuration is necessary. Crystallinity of the titanium oxide film in oxidation using an RTA device is superior as compared with oxidation using a general furnace. This is because, according to the oxidation using a normal heating furnace, the titanium film which is easy to be oxidized makes several crystal structures at a low temperature and these crystal structures need to be destroyed. Therefore, the oxidation using the RTA with a fast temperature rising rate is advantageous because superior crystal is formed. As materials other than Ti, materials such as Ta, Ir, and Ru can be used. A film thickness of the adhesion layer is preferably in a range from 10 [nm] to 50 [nm] and is more particularly in a range from 15 [nm] to 30 [nm]. When the film thickness is smaller than a film thickness in the range, this affects adhesion and when the film thickness is larger than the film thickness in the range, this affects a quality of crystal of an electrode film formed on the adhesion layer.

[Metal Electrode Film]

As a metal material of a metal electrode film, platinum having high heat resistance and low reactivity is used conventionally. However, the platinum does not have a sufficient barrier property for lead in some cases and platinum group elements such as iridium and platinum-rhodium or alloy films thereof may be used. In addition, the adhesion layer is preferably previously stacked, because adhesion with a base (in particular, $SiO_2$) is bad, when the platinum is used. As a method of manufacturing the metal electrode film, vacuum film formation such as a sputtering method or a vacuum vapor deposition method is generally used. A film thickness is preferably in a range from 80 [nm] to 200 [nm] and is more preferably 100 [nm] to 150 [nm]. When the film thickness is smaller than a film thickness in the range, a sufficient current cannot be supplied as the common electrode 161 and a failure occurs when the droplets are discharged. When the film thickness is larger than the film thickness in the range, when expensive materials of the platinum group elements are used, a cost increases. When the platinum is used as the material and the film thickness is large, surface roughness increases, this affects surface roughness or crystal orientation of an oxide electrode film or PZT formed on the metal electrode film, and sufficient displacement is not obtained in discharging the ink.

[Oxide Electrode Film]

As a material of the oxide electrode film, strontium ruthenate ($SrRuO_3$, hereinafter, simply referred to as "SRO") is preferably used. A material obtained by substituting a part of strontium ruthenate, specifically, a material represented by $Sr_xA_{(1-x)}Ru_yB_{(1-y)}O_3$ (in the formula, A is Ba and Ca, B is Co and Ni, and x and y=0 to 0.5) is also preferably used. The oxide electrode film can be manufactured using a film forming method such as a sputtering method. A film quality of a thin film of $SrRuO_3$ changes according to sputtering conditions. Therefore, it is preferable to form a film by performing substrate heating at a film formation temperature of 500 [° C.] or more, for (111) orientation for the film of $SrRuO_3$ according to Pt (111) of the common electrode with the emphasis on the crystalline orientation in particular. For example, under SRO film formation conditions described in JP-2004-202849-A, after a film is formed at a room temperature, thermal oxidation is performed using RTA processing at a crystalline temperature (650° C.). In this case, the film is sufficiently crystallized as the SRO film and a sufficient value is obtained as specific resistance of the electrode. As the crystal orientation of the film, (110) is easy to be preferentially oriented and (110) is easy to be oriented for the PZT formed thereon.

For crystallinity of SRO manufactured on Pt (111), because lattice constants are close in Pt and SRO, 2θ positions of SRO (111) and Pt (111) overlap in θ-2θ measurement of normal X rays and determination is difficult. For Pt, at a position where 2θ inclined by Psi=35° from a relation of an extinction rule is near about 32°, diffraction lines are cancelled and diffraction strength is not viewed. For this reason, a Psi direction is inclined by about 35° and 2θ is determined at peak strength near about 32°, so that it is confirmed that SRO is preferentially oriented in (111).

Figure 16:
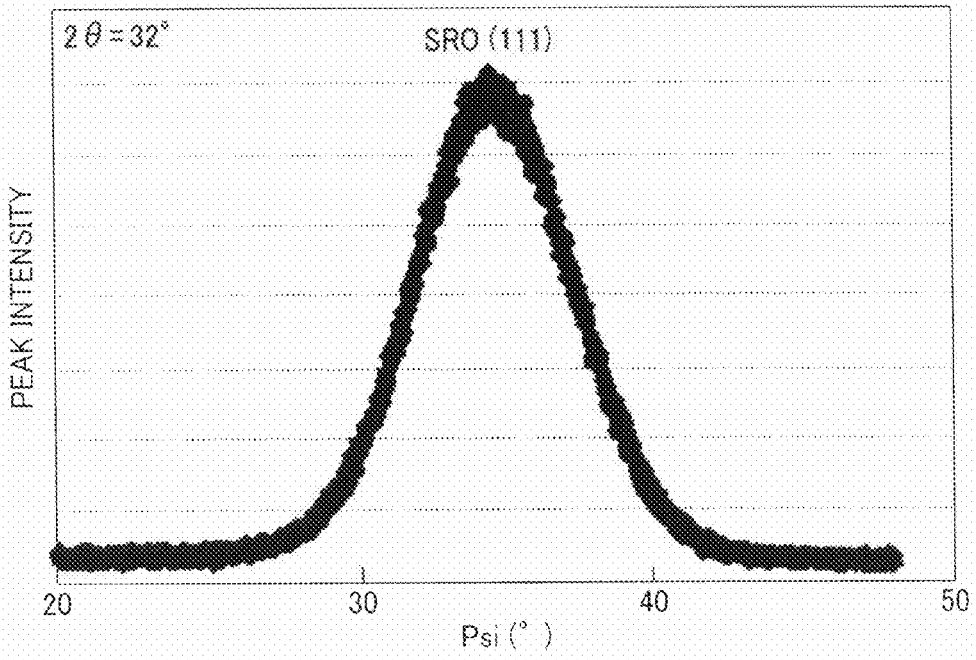
FIG. 16 is a characteristic view illustrating an X-ray diffraction measurement result of a sample forming a $SrRuO_3$ film according to an embodiment of the present disclosure.

FIG. 16 illustrates data when 2θ is fixed to 32° and Psi changes. At Psi=0°, diffraction strength is rarely viewed in SRO (110) and the diffraction strength is viewed near Psi=35°. Thereby, it is confirmed that SRO is (111) oriented, when SRO is manufactured under the film formation conditions. For SRO manufactured by the film formation at the room temperature and the RTA processing mentioned above, the diffraction strength of SRO (110) is viewed at Psi=0°.

When a continuous operation as the piezoelectric actuator is performed and a deterioration amount of a displacement amount after drive for initial displacement is estimated, orientation of the PZT affects the displacement amount and displacement deterioration suppression is insufficient in (110). At the surface roughness of the SRO film, the film formation temperature affects the surface roughness and the surface roughness is very small and becomes 2 [nm] or less, from the room temperature to 300° C. For the roughness, surface roughness (average roughness) measured by AFM is used as an index. The surface roughness is very flat. However, crystallinity is not sufficient and a sufficient characteristic is not obtained for initial displacement of the subsequently formed piezoelectric layer (PZT film) as the piezoelectric actuator or the displacement deterioration after the continuous drive. The surface roughness is preferably in a range of 4 [nm] to 15 [nm] and is more preferably in a range of 6 [nm] to 10 [nm]. If the surface roughness is larger than surface roughness in the range, a dielectric strength voltage of the subsequently formed PZT film is very low and leakage occurs easily. Therefore, a film is formed at the film formation temperature in a range of 500 [° C.] to 700 [° C.], preferably, a range of 520 [° C.] to 600 [° C.] in order to obtain the crystallinity and surface roughness mentioned above.

As a composition ratio of Sr and Ru after the film formation, Sr/Ru is preferably 0.82 to 1.22. If the composition ratio is out of the range, specific resistance increases and sufficient conductivity is not obtained as an electrode. The film thickness of the SRO film is preferably in a range of 40 [nm] to 150 [nm] and is more preferably in a range of 50 [nm] to 80 [nm]. If the film thickness is smaller than a film thickness in the range, a sufficient characteristic is not obtained as the initial displacement or the displacement deterioration after the continuous drive and it becomes difficult to obtain a function as an etching stop layer to suppress overetching of the piezoelectric layer (PZT film). If the film thickness is larger than the film thickness in the range, a dielectric strength voltage of the subsequently formed piezoelectric layer (PZT film) 162 is very low and leakage occurs easily. In addition, the specific resistance is preferably $5\times10^{-3}$ [Ω·cm] or less and is more preferably $1\times10^{-3}$ [Ω·cm] or less. If the specific resistance is higher than specific resistance in the range, contact resistance at an interface with the common electrode lead-out wiring line 20 is not sufficiently obtained as the common electrode 161, a sufficient current cannot be supplied as the common electrode 161, and a failure occurs when the droplets are discharged.

[Piezoelectric Layer (Electromechanical Transduction Film)]

As a material of the piezoelectric layer 162, PZT is mainly used. The PZT is a solid solution of lead zirconate ($PbTiO_3$) and titanium acid ($PbTiO_3$) and has a characteristic different according to a ratio of the lead zirconate ($PbTiO_3$) and the titanium acid ($PbTiO_3$). In a composition showing a generally superior piezoelectric characteristic, a ratio of $PbZrO_3$ and $PbTiO_3$ is 53:47. If the composition is represented by a chemical formula, the composition is represented by $Pb(Zr_{0.53}Ti_{0.47})O_3$, generally, PZT (53/47). As composite oxide other than the PZT, barium titanate is exemplified. In this case, barium alkoxide and titanium alkoxide compounds are used as a starting material and are dissolved in a common solvent, so that a barium titanate precursor solution can be produced. This material is represented by a general formula $ABO_3$ and composite oxide using A=Pb, Ba, and Sr and B=Ti, Zr, Sn, Ni, Zn, Mg, and Nb as main components corresponds to the material. Chemical formulas of the composite oxide are represented by $(Pb_{1-x}, Ba_x)(Zr, Ti)O_3$ or $(Pb_{1-x}, Sr_x)(Zr, Ti)O_3$, specifically. The chemical formulas show chemical formulas when a part of Pb of the A site is substituted with Ba or Sr. The substitution is enabled in a bivalent element and an effect thereof is to decrease characteristic deterioration by the evaporation of the lead during the heat treatment.

As a method of manufacturing the piezoelectric layer 162, the piezoelectric layer can be manufactured by a spin coater using a sputtering method or a sol-gel method. In this case, because patterning is necessary, a desired pattern is obtained by photolithoetching. When the PZT is manufactured by the sol-gel method, lead acetate, zirconium alkoxide, and titanium alkoxide compounds are used as starting materials and are dissolved in methoxyethanol functioning as a common solvent and a uniform solution is obtained. Thereby, a PZT precursor solution can be produced. Because a metal alkoxide compound is hydrolyzed by atmospheric water easily, acetylacetone, acetic acid, diethanolamine functioning as stabilizers may be appropriately added to the PZT precursor solution.

When the piezoelectric layer (PZT film) 162 is obtained on an entire surface of the substrate 14, the piezoelectric layer is obtained by forming a coating by a solution coating method such as a spin coating method and performing each heat treatment of solvent drying, thermal decomposition, and crystallization. Because transformation from the coating to the crystalline film causes volume contraction, a concentration of the precursor solution needs to be adjusted to obtain a film thickness of 100 [nm] or less by one step in order to obtain a crack-free film.

A film thickness of the piezoelectric layer 162 is preferably in a range of 0.5 μM to 5 μm and is more preferably in a range of 1 μm to 2 μm. If the film thickness is smaller than a film thickness in the range, sufficient deformation (displacement) cannot be generated and if the film thickness is larger than the film thickness in the range, the number of steps increases to stack many layer and a processing time increases.

In addition, relative permittivity of the piezoelectric layer 162 is preferably in a range from 600 to 2000 and is more preferably in a range from 1200 to 1600. At this time, if the relative permittivity is smaller than relative permittivity in the range, a sufficient deformation (displacement) characteristic is not obtained. Meanwhile, if the relative permittivity is larger than the relative permittivity in the range, the polarization processing is not sufficiently executed and a sufficient characteristic is not obtained for the displacement deterioration after the continuous drive.

[Individual Electrode (Upper Electrode)]

The individual electrode (upper electrode) 163 is preferably formed using a metal or oxide and the metal. Hereinafter, an oxide electrode film and a metal electrode film will be described in detail.

[Oxide Electrode Film]

As a material of the oxide electrode film, the same material as the oxide electrode film used in the common electrode (lower electrode) 161 can be exemplified. A film thickness of the oxide electrode film (SRO film) is preferably in a range from 20 [nm] to 80 [nm] and is more preferably in a range from 40 [nm] to 60 [nm]. If the film thickness is smaller than a film thickness in the range, a sufficient characteristic is not obtained as the initial deformation (displacement) or the deterioration characteristic of the deformation (displacement). If the film thickness is larger than the film thickness in the range, a dielectric strength voltage of the subsequently formed piezoelectric layer (PZT film) is very low and leakage occurs easily.

[Metal Electrode Film]

As a material of the metal electrode film, the same material as the metal electrode film used in the common electrode (lower electrode) 161 can be exemplified. A film thickness of the metal electrode film is preferably in a range from 30 [nm] to 200 [nm] and is more preferably in a range from 50 [nm] to 120 [nm]. When the film thickness is smaller than a film thickness in the range, a sufficient current cannot be supplied as the individual electrode 163 and a failure occurs when the droplets are discharged. If the film thickness is larger than the film thickness in the range, when expensive materials of the platinum group elements are used, a cost increases. When the platinum is used as the material and the film thickness is large, surface roughness increases and a process failure such as peeling of film is easy to occur at the time of manufacturing a wiring line through the insulation protective film.

[First Insulation Protective Film]

Because it is necessary to select a material which prevents damage of the piezoelectric element by the film formation/etching process and which atmospheric moisture is hard to pass through, a minute inorganic material needs to be used as the material of the first insulation protective film 18. When an organic material is used as the first insulation protective film 18, it is necessary to increase a film thickness to obtain sufficient protection performance and thus, the organic material is not preferable. When the film thickness of the first insulation protective film 18 is large, this hampers the vibration of the diaphragm 15 remarkably and discharging performance of the droplet discharge head is deteriorated. In order to obtain high protection performance in a thin film, it is preferable to use oxide, nitride, a carbonized film. However, it is necessary to select a material having high adhesiveness with an electrode material, a piezoelectric layer material, and a diaphragm material becoming a base of the first insulation protective film 18. In addition, it is necessary to select a film forming method not damaging the piezoelectric element 16 as a method of forming the first insulation protective film 18. That is, a plasma CVD method turning reactive gas into plasma and depositing the plasma on the substrate or a sputtering method making the plasma collide with a target material, emitting the plasma, and forming a film is not preferable. As a preferable film forming method of the first insulation protective film 18, a vapor deposition method and an atomic layer deposition (ALD) method can be exemplified. However, the ALD method in which a choice of materials to be used is wide is preferable. As the preferable material, an oxide film used for ceramic materials such as $Al_2O_3$, $ZrO_2$, $Y_2O_3$, $Ta_2O_3$, and $TiO_2$ are exemplified. Particularly, the ALD method is used, so that a thin film having a high film density is manufactured, and the damage in the process can be suppressed.

The first insulation protective film 18 needs to have a film thickness enabling protection performance of the piezoelectric element 16 to be secured and needs to be formed thinly not to hamper deformation (displacement) of the diaphragm 15. The film thickness of the first insulation protective film 18 is preferably in a range from 20 [nm] to 100 [nm]. When the film thickness is larger than 100 [nm], a deformation (displacement) amount of the diaphragm 15 decreases and thus, discharge efficiency of the droplet discharge head is low. Meanwhile, when the film thickness is smaller than 20 [nm], a function as a protection layer of the piezoelectric element 16 may be insufficient and thus, performance of the piezoelectric element 16 may be deteriorated as described above.

In addition, a configuration in which the first insulation protective film 18 is formed using two layers is considered. In this case, because an insulation protective film of the second layer is thick, the insulation protective film of the second layer is opened near the individual electrode (upper electrode) 163 not to hamper the vibration of the diaphragm 15 remarkably. As the insulation protective film of the second layer, any oxide, nitride, and carbide or a composite compound thereof can be used and $SiO_2$ generally used in a semiconductor device can be used. Any method can be used when the first insulation protective film 18 of the second layer is formed. For example, the CVD method and the sputtering method can be exemplified. If step coating of a pattern forming part of an electrode forming part is considered, the CVD method forming a film isotropically is preferably used. The film thickness of the insulation protective film of the second layer needs to be a film thickness at which dielectric breakdown does not occur by a voltage applied between the common electrode (lower electrode) 161 and the individual electrode lead-out wiring line 22. That is, the strength of the electric field applied to the first insulation protective film 18 needs to be set in a range in which the dielectric breakdown does not occur. If surface nature or a pinhole of the base of the first insulation protective film 18 is considered, the film thickness of the first insulation protective film 18 is preferably 200 [nm] or more and is more preferably 500 [nm] or more.

[Wiring Line]

A material of the common electrode lead-out wiring line 20 and the individual electrode lead-out wiring line 22 is preferably a metal electrode material made of any one of an Ag ally, Cu, Al, Au, Pt, and Ir. The wiring line is manufactured using the sputtering method and the spin coating method and then a desired pattern is obtained by photolithoetching. The film thickness is preferably in a range from 0.1 μm to 20 μm and is more preferably in a range from 0.2 μm to 10 μm. If the film thickness is smaller than a film thickness in the range, resistance increases, a sufficient current cannot be flown to the electrode, and the head discharge becomes unstable. Meanwhile, if the film thickness is larger than the film thickness in the range, a processing time increases. In addition, contact resistance in a contact hole (for example, 10 μm×10 μm) connected to the common electrode 161 and the individual electrode 163 is preferably 10 [Ω] or less for the common electrode 161 and is preferably 1 [Ω] or less for the individual electrode 163. The contact resistance is more preferably 5 [Ω] or less for the common electrode 161 and is preferably 0.5 [Ω] or less for the individual electrode 163. If the contact resistance is higher than contact resistance in the range, a sufficient current cannot be supplied and a failure occurs when the droplets are discharged.

A portion of the common electrode lead-out wiring line 20 exposed from the opening 23*a* of the second insulation protective film 23 becomes the common electrode pad 19 functioning as a terminal electrode for a lower portion. In addition, a portion of the individual electrode lead-out wiring line 22 exposed from the opening 23*a* of the second insulation protective film 23 becomes the individual electrode pad 21 functioning as a terminal electrode for an upper portion.

[Second Insulation Protective Film]

The second insulation protective film 23 is a passivation layer that has a function as a protection layer of the individual electrode lead-out wiring line 22 or the common electrode lead-out wiring line 20. As described above, the second insulation protective film 23 coats the individual electrode lead-out wiring line 22 or the common electrode lead-out wiring line 20, except for the opening 23*a* to form the individual electrode pad 21 and the opening 23*a* to form the common electrode pad 19. Thereby, cheap Al or an alloy material using Al as a main component can be used in an electrode material. As a result, a droplet discharge head (inkjet head) that is low in cost and has high reliability can be realized. As a material of the second insulation protective film 23, any inorganic material and any organic material can be used. However, it is necessary to use a material with low moisture permeability. As the inorganic material, oxide, nitride, and carbide can be exemplified. As the organic material, polyimide, acrylic resin, and urethane resin can be exemplified. However, in the case of the organic material, because the film thickness needs to be large, the organic material is not suitable for patterning. For this reason, it is preferable to use the inorganic material that can show a wiring protection function in a thin film. Particularly, it is preferable to use $Si_3N_4$ on the Al wiring line because it is the technique proven in a semiconductor device. In addition, the film thickness is preferably 200 [nm] or more and is more preferably 500 [nm] or more. When the film thickness is small, a sufficient passivation function cannot be shown. For this reason, disconnection caused by corrosion of a material of the wiring line occurs and reliability of the inkjet head is deteriorated.

In addition, a structure in which openings are provided on the piezoelectric element 16 and the diaphragm 15 around the piezoelectric element is preferable. The reason is the same as the reason why the area of the first insulation protective film 18 corresponding to the individual chamber is formed thinly. Thereby, a droplet discharge head (inkjet head) that has high efficiency and high reliability can be realized.

Because the piezoelectric element 16 is protected by the insulation protective films 18 and 23, a photolithographic technique and dry etching can be used when the opening of the second insulation protective film 23 is formed. In addition, the areas of the individual electrode pad 21 and the common electrode pad 19 provided by the opening of the second insulation protective film 23 are preferably 50×50 [$\mu m^2$] or more and is more preferably 100×300 [$\mu m^2$] or more. When the areas do not satisfy the values, sufficient polarization processing cannot be executed and a sufficient characteristic is not obtained for deformation (displacement) deterioration after continuous drive.

(Holding Substrate)

Because the actuator substrate obtained by forming the above mentioned member such as the piezoelectric element 16 on the substrate 14 has a thickness of 20 to 100 μM, the actuator substrate is bonded to the holding substrate 26 to secure rigidity of the actuator substrate. As a material of the holding substrate 26, any material can be used. However, it is necessary to select a material having a close thermal expansion coefficient to prevent warping of the actuator substrate. For this reason, glass, silicon, or a ceramic material such as $SiO_2$, $ZrO_2$, and $Al_2O_3$ is preferably used. The holding substrate 26 has the recess portion 26*a* to cover the piezoelectric element 16 with a void therebetween and an opening to from a part of a common liquid supply channel supplying a liquid to the plurality of liquid chambers 13. In addition, the holding substrate 26 has the opening 26*c* for the common pad to expose the common electrode pad 19 and the opening 26*d* for the individual electrode pad to expose the individual electrode pad 21.

Next, specific examples of the polarization processing using the discharge in the method of manufacturing the droplet discharge head according to this embodiment will be described.

Example 1

In an example 1, a thermal oxide film (film thickness of 1 μm) was formed on a 6-inch silicon wafer as a substrate 14 and a common electrode 161 was formed. First, after a titanium film (film thickness of 30 [nm]) corresponding to an adhesion film of the common electrode 161 was formed by a sputtering device at the film formation temperature of 350 [° C.] and was thermally oxidized at the temperature of 750 [° C.] using RTA. Then, a platinum film (film thickness of 100 [nm]) corresponding to a metal film was formed by the sputtering device at the film formation temperature of 550 [° C.] and a SrRuO film (film thickness of 50 [nm]) corresponding to an oxide film was formed by sputtering. After the substrate heating temperature when the SrRuO film was formed by the sputtering was set to 550 [° C.], post-annealing treatment (550 [° C.]) was performed using the RTA.

Next, a piezoelectric layer (electromechanical transduction film) 162 was formed. First, a solution adjusted to Pb:Zr:Ti=115:53:47 was prepared and a film was formed using a spin coating method. Here, the film was formed using a sputtering device in which a plurality of targets are provided for one chamber as the sputtering device.

For synthesis of a specific precursor coating liquid, lead acetate trihydrate, titanium isopropoxide, and zirconium isopropoxide were used as starting materials. Crystal water of lead acetate was dissolved in methoxyethanol and was then dehydrated. A quantity of lead is excessively large for a stoichiometric composition. This is to prevent reduction in crystallinity by so-called lead missing during heat treatment. The titanium isopropoxide and the zirconium isopropoxide were dissolved in methoxyethanol, an alcohol exchange reaction and an esterification reaction were advanced, a resultant was mixed with a methoxyethanol solution having dissolved the lead acetate, and the PZT precursor solution was synthesized. A concentration of the PZT in the PZT precursor solution was 0.5 [mol/l]. After a film was formed by a spin coating method using the PZT precursor solution, 120° C. dry and 500° C. thermal decomposition were performed. After a thermal decomposition process was executed on a third layer, crystallization heat treatment (temperature of 750° C.) was executed by rapid thermal annealing (RTA). At this time, a film thickness of the PZT was 240 [nm]. This process was executed 8 times (corresponding to 24 layers), so that a PZT film having a film thickness of about 2 μm was obtained.

Next, an individual electrode 163 was formed. First, a SrRuO film (film thickness of 40 [nm]) corresponding to an oxide film of the individual electrode 163 and a Pt film (film thickness of 125 [nm]) corresponding to a metal film were formed using sputtering. Then, a film was formed by the spin coating method using a photoresist (TSMR8800) manufactured by TOKYO OHKA KOGYO., LTD, a resist pattern was formed by a normal photolithographic technique, and a pattern illustrated in FIGS. 5A and 5B was manufactured using an ICP etching device (manufactured by SAMCO INC.).

Next, an $Al_2O_3$ film having a film thickness of 50 [nm] was formed as a first insulation protective film 18, using an ALD method. At this time, TMA (manufactured by Sigma-Aldrich Co. LLC.) was used as a raw material of Al, $O_3$ generated by an ozone generator was used as a raw material of O, and film formation was advanced by stacking Al and O alternately. Then, as illustrated in FIGS. 4 to 5B, a contact hole 18*a* was formed by etching.

Next, a film of Al was formed as a common electrode lead-out wiring line 20, an individual electrode lead-out wiring line 22, a common electrode pad 19, and an individual electrode pad 21 by sputtering and the common electrode lead-out wiring line 20, the individual electrode lead-out wiring line 22, the common electrode pad 19, and the individual electrode pad 21 were separated by the etching.

Next, a film of $Si_3N_4$ having a film thickness of 500 [nm] was formed as a second insulation protective film 23, using a plasma CVD method. Then, an opening 23*a* and the like were formed by the etching and an actuator substrate illustrated in FIGS. 5A and 5B in which the common electrode pad 19 and the individual electrode pad 21 were arranged in a row shape was manufactured.

Next, a silicon substrate (400 μm) in which a recess portion 26*a*, an opening 26*c* for a common pad, and an opening 26*d* for an individual pad are formed, which corresponds to a holding substrate 26, was bonded to the actuator substrate by an adhesive material. Here, individual values of the distances D1 to D6 were set as represented by Table 1.

Then, polarization processing was executed by corona charging. In the corona charging, tungsten wire of ϕ50 μm was used as a corona electrode 71. Polarization processing conditions were a processing temperature of 80 [° C.], a corona voltage of 9 [kV], a grid voltage of 2.5 [kV], a processing time of 30 [s], a distance between the corona electrode and the grid electrode to be 4 [mm], and a distance between the grid electrode and a stage to be 4 [mm].

Example 2

An example 2 was the same to the example 1, except that the individual values of the distances D1 to D6 were set as represented by Table 1. The actuator substrate and the holding substrate 26 were manufactured and the polarization processing was executed by the corona discharge.

Example 3

An example 3 was the same to the example 1, except that the individual values of the distances D1 to D6 were set as represented by Table 1. The actuator substrate and the holding substrate 26 were manufactured and the polarization processing was executed by the corona discharge.

Example 4

An example 4 was the same to the example 1, except that the individual values of the distances D1 to D6 were set as represented by Table 1. The actuator substrate and the holding substrate 26 were manufactured and the polarization processing was executed by the corona discharge.

Example 5

An example 5 was the same to the example 1, except that the individual values of the distances D1 to D6 were set as represented by Table 1. The actuator substrate and the holding substrate 26 were manufactured and the polarization processing was executed by the corona discharge.

Example 6

An example 6 was the same to the example 1, except that the individual values of the distances D1 to D6 were set as represented by Table 1. The actuator substrate and the holding substrate 26 were manufactured and the polarization processing was executed by the corona discharge.

Comparative Example 1

A comparative example 1 was the same to the example 1, except that the individual values of the distances D1 to D6 were set as represented by Table 1. The actuator substrate and the holding substrate 26 were manufactured and the polarization processing was executed by the corona discharge.

<Result>

For the examples 1 to 6 and the comparative example 1 described above, a polarization state (polarization amount difference) and electromechanical transduction ability (piezoelectric constant) were evaluated. The electromechanical transduction ability (piezoelectric constant) was calculated from measurement of a deformation amount by field application (150 [kV/cm]) by a laser Doppler vibrometer and adjustment by simulation. In addition, after an initial characteristic was evaluated, durability (characteristic immediately after an application voltage is applied $1\times10^{10}$ times repetitively) was evaluated. The individual values of the distances D1 to D6 and the evaluation results are collected in Table 1.

[Table 1]

As the test results of the initial characteristic and the durability for the examples 1 to 6, the same characteristics as a general ceramic sintered object were obtained. Specifically, polarizability was 4 [$\mu C/cm^2$] or less, an initial characteristic of a piezoelectric constant was 130 to 140 [pm/V], a change from the initial characteristic after the durability test was small, and superior electromechanical transduction ability was shown. Particularly, it was confirmed in the examples 1 to 5 that the polarization processing with high efficiency was executed and superior electromechanical transduction ability was shown.

Meanwhile, in the comparative example 1, the polarizability was 21 [μC/cm$^2$]. In addition, the initial characteristic of the piezoelectric constant was 148 [pm/V]. However, the piezoelectric constant greatly changed after the durability evaluation.

Thereby, it was confirmed that the arrangement (distance D1) of the opening 26*c* for the common pad and the opening 26*d* for the individual pad and the arrangement (distance D6) of the common electrode pad 19 and the individual electrode pad 21 were set as described above and the piezoelectric element 16 with the superior polarization characteristic was obtained. In addition, the distances (distances D2 and D4) from the center of the common electrode pad 19 to the end of the opening 26*c* for the common pad and the distances (distances D3 and D5) from the center of the individual electrode pad 21 to the end of the opening 26*d* for the individual pad were set as described above. Thereby, it was confirmed that the polarization processing was executed with high efficiency.

As described above, according to this embodiment, the piezoelectric element 16 having the same performance as bulk ceramics can be formed by the simple manufacturing steps. As illustrated in FIG. 1, etching removal from the back surface to form the liquid chamber (pressure chamber) 13 is performed, the nozzle plate 12 having the nozzles 11 is bonded, and the droplet discharge head can be manufactured. In FIG. 1, a liquid supply unit, a channel, and fluid resistance are not illustrated.

The droplet discharge evaluation was performed using the droplet discharge head manufactured using the piezoelectric element 16 manufactured in the examples 1 to 6. As the confirmation result of the discharge situation when the voltage of −10 [V] to −30 [V] was applied by a simple push waveform using ink of which viscosity was adjusted to 5 [cp], the ink droplets could be discharged from all of the nozzles 11.

In the embodiment described above, the case in which the polarization processing is executed with the charges generated by the corona discharge has been described. However, the same effect is obtained in the same configuration, even when the polarization processing is executed with the charges generated by the glow discharge.

Next, an inkjet recording apparatus to be an image forming apparatus including the droplet discharge head according to this embodiment will be described.

Figure 17:
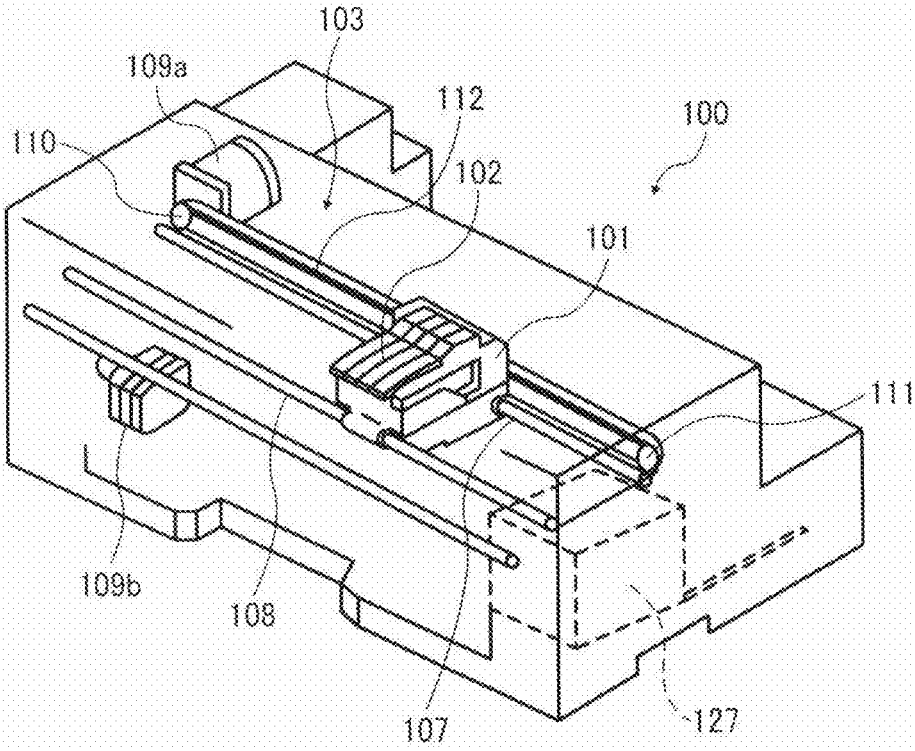
FIG. 17 is a perspective view illustrating a configuration example of an inkjet recording apparatus including the droplet discharge head according to an embodiment of the present disclosure.
Figure 18:
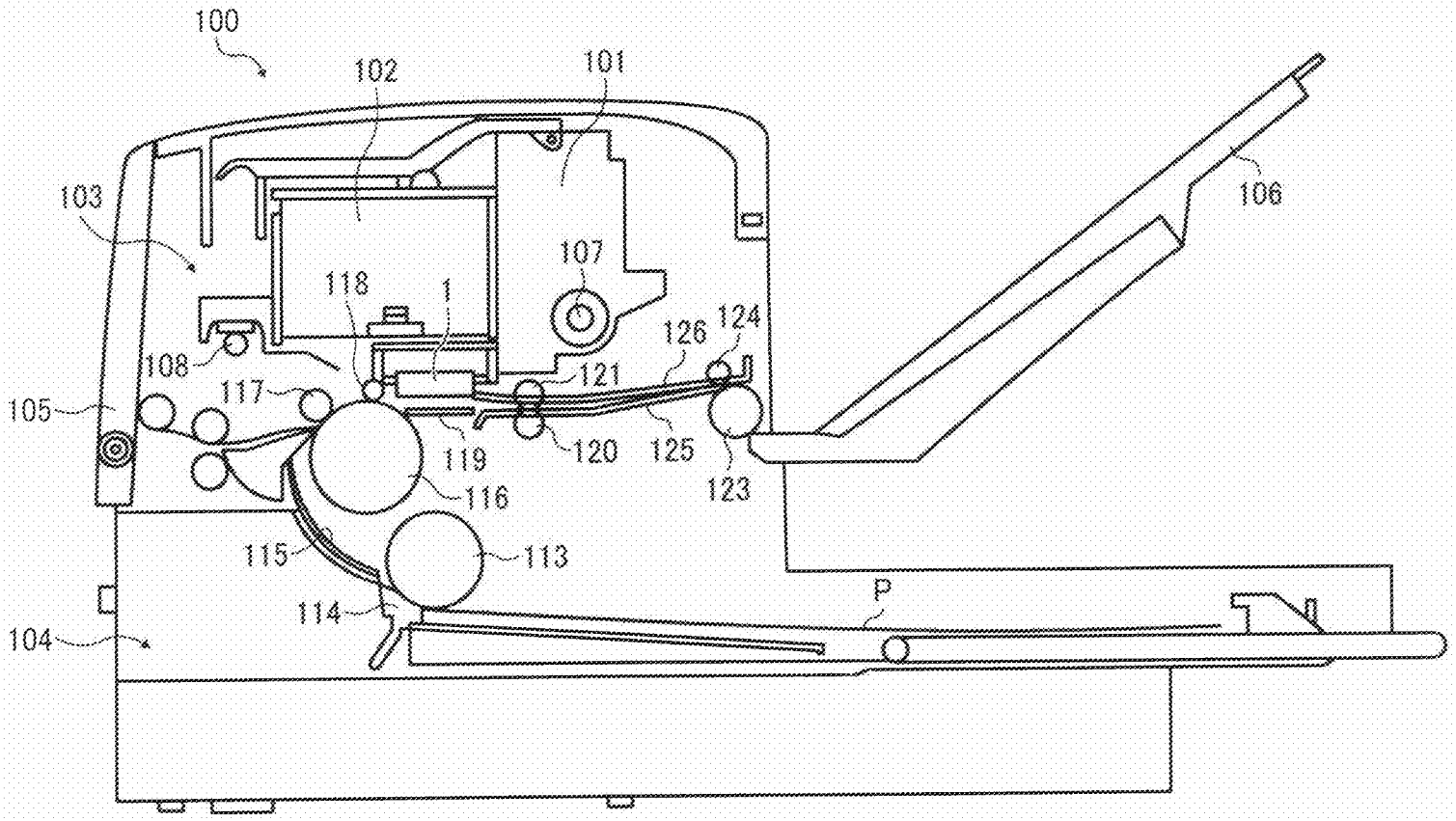
FIG. 18 is a side view illustrating a configuration example of an assembly part of the inkjet recording apparatus including the droplet discharge head according to an embodiment of the present disclosure.
Figure 19A:
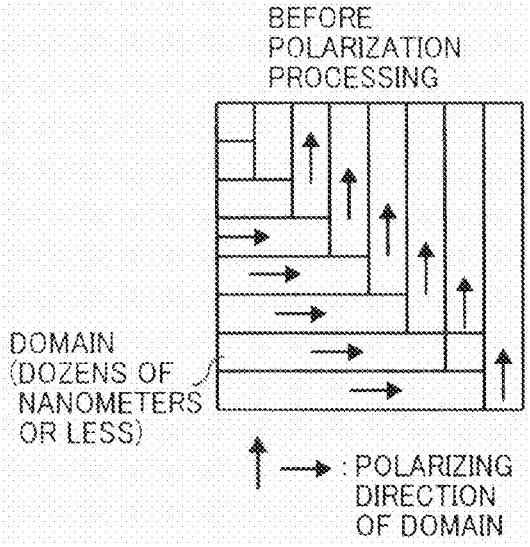
FIGS. 19A and 19B are diagrams illustrating aspects of a domain of a piezoelectric layer before and after polarization processing, respectively according to an embodiment of the present disclosure.
Figure 19B:
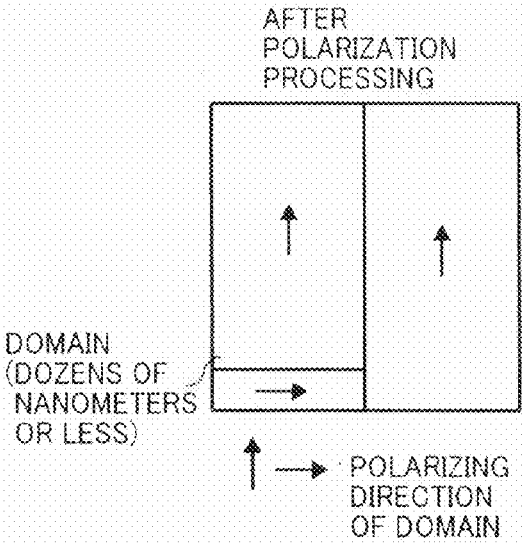

FIG. 17 is a perspective view illustrating a configuration example of the inkjet recording apparatus on which the droplet discharge head is mounted and FIG. 18 is a side view illustrating a configuration example of an assembly of the inkjet recording apparatus.

In an inkjet recording apparatus 100, a printing assembly 103 is stored in an apparatus body and a sheet feeding tray (sheet feeding cassette) 104 that can load multiple recording sheets P from the front side is removably mounted on a lower portion of the apparatus body. In addition, the inkjet recording apparatus 100 has a manual feed tray 105 opened to manually feed the recording sheets P. The recording sheets P fed from the sheet feeding tray 104 or the manual feed tray 105 are taken, a desired image is recorded by the printing assembly 103, and the recording sheets are ejected to an ejection tray 106 mounted on the rear side.

The printing assembly 103 includes a carriage 101 that can move in a main scanning direction, a droplet discharge head mounted on the carriage 101, and an ink cartridge 102 functioning as a liquid cartridge that supplies ink to the droplet discharge head. In addition, the printing assembly 103 slidably holds the carriage 101 in the main scanning direction by a main guide rod 107 and a sub-guide rod 108 to be guide members bridged laterally between left and right side plates in the drawings. In the carriage 101, a plurality of ink discharge ports (nozzles) of the droplet discharge head to discharge ink droplets of individual colors of yellow (Y), cyan (C), magenta (M), and black (Bk) are arranged in a direction crossing the main scanning direction and are mounted with an ink-droplet discharge direction as a downward direction. In addition, each ink cartridge 102 to supply ink of each color to the droplet discharge head is mounted on the carriage 101 to be exchangeable.

The ink cartridge 102 has an air port communicating with the atmosphere at the upper side and has a supply port to supply ink to the droplet discharge head at the lower side. In the ink cartridge 102, a porous material into which ink is filled is provided. The ink supplied to the liquid discharge head by capillary force of the porous material is maintained in slight negative pressure. As the droplet discharge head, the droplet discharge head of each color is used. However, one droplet discharge head that has a plurality of nozzles to discharge ink droplets of each color may be used.

Here, the rear side (the downstream side of a sheet conveyance direction) of the carriage 101 is slidably fit into the main guide rod 107 and the front side (the upstream side of the sheet conveyance direction) thereof is slidably placed on the sub-guide rod 108. In addition, a timing belt 112 is stretched between a driving pulley 110 driven to rotate by a main scanning motor 109*a* and a driven pulley 111 to move the carriage 101 in the main scanning direction and the timing belt 112 is fixed on the carriage 101. Thereby, the carriage 101 is reciprocatingly driven by forward and reverse rotation of the main scanning motor 109*a*.

Meanwhile, a sheet feeding roller 113 and a friction pad 114 to separate and feed the recording sheets P from the sheet feeding tray 104 and a guide member 115 to guide the recording sheets P are included to convey the recording sheets P set to the sheet feeding tray 104 to the lower side of the droplet discharge head. In addition, a conveyance roller 116 to invert the fed recording sheets P and convey the recording sheets P and a leading edge roller 118 to define a feeding angle of the recording sheets P from a conveyance roller 117 pushed to a circumferential surface of the conveyance roller 116 and the conveyance roller 116 are included. The conveyance roller 116 is driven to rotate through a gear train by a sub-scanning motor 109*b*.

In addition, a print receiver 119 to be a sheet guide member that guides the recording sheets P fed from the conveyance roller 116 at the lower side of the droplet discharge head to correspond to a movement range of the main scanning direction of the carriage 101 is provided. On the downstream side of the sheet conveyance direction of the print receiver 119, a conveyance roller 120 and a spur roller 121 driven to rotate to feed the recording sheets P in an ejection direction are provided. In addition, an ejection roller 123 and a spur roller 124 to feed the recording sheets P to the ejection tray 106 and guide members 125 and 126 to form an ejection pathway are arranged.

When recording is performed by the inkjet recording apparatus 100 having the above configuration, the droplet discharge head is driven according to an image signal while the carriage 101 is moved, ink is discharged to the stopped recording sheets P, recording of one row is performed, and recording of a next row is performed after the recording sheets P are conveyed by a predetermined amount. When a recording end signal or a signal showing that rear ends of the recording sheets P arrive at a recording area is received, a recording operation is terminated and the recording sheets P are ejected.

In addition, a recovery device 127 to recover discharge failure of the droplet discharge head is arranged at a position deviating from a recording area of the right end side of a movement direction of the carriage 101. The recovery device 127 has a capping unit, a suction unit, and a cleaning unit. The carriage 101 moves to the side of the recovery device 127 in a printing standby mode, the droplet discharge head is capped by the capping unit, the discharge port is maintained in a wet state, and the discharge failure is prevented from occurring due to ink dry. In addition, ink discharge not associated with the recording is performed in the middle of the recording, so that ink viscosity of all discharge ports is constantly maintained, and stable discharging performance is maintained.

When the discharge failure occurs, the discharge ports (nozzles) of the droplet discharge head 1 are sealed by the capping unit and ink and bubbles are sucked from the discharge ports by the suction unit through a tube. Thereby, ink or dusts adhered to a discharge port face is removed by the cleaning unit and the discharge failure is recovered. In addition, the sucked ink is ejected to a waste ink container arranged on a lower portion of the body, is absorbed into an ink absorber in the waste ink container, and is held in the ink absorber. As such, in the inkjet recording apparatus 100 according to this embodiment, because the recovery device 127 is provided, the discharge failure of the droplet discharge head is recovered, a stabilized ink droplet discharge characteristic is obtained, and an image quality can be improved.

In this embodiment, the case in which the droplet discharge head is used in the inkjet recording apparatus 100 has been described. However, the droplet discharge head 1 may be applied to an apparatus that discharges a droplet other than the ink, for example, liquid resist for patterning.

In the inkjet recording apparatus (image forming apparatus) 100 according to this embodiment, because the liquid discharge head according to the present disclosure is included as the recording head, an image with a high quality can be formed stably.

In addition, the image forming apparatus includes both a serial-type image forming apparatus and a line-type image forming apparatus, as long as a limitation is not given in particular.

The above description is exemplary and the present disclosure achieves a particular effect for each of the following aspects.

(Aspect A)

A droplet discharge head includes a liquid chamber (e.g., liquid chamber 13) communicated with a nozzle such as the nozzle 11 to discharge droplets. An electromechanical transducer such as a piezoelectric element 16 that is provided on a substrate such as the substrate 14 to form the liquid chamber such as the liquid chamber 13 to pressurize a liquid in the liquid chamber such as the liquid chamber 13; a first terminal electrode such as the common electrode pad 19 that is connected to a first drive electrode such as the common electrode 161 in the electromechanical transducer at the side of the substrate; a second terminal electrode such as the individual electrode pad 21 that is connected to a second drive electrode such as the individual electrode 163 in the electromechanical transducer at the side opposite to the side of the substrate; and a holding substrate such as the holding substrate 26 that is provided to cover the electromechanical transducer to be displaceable. The holding substrate has a first opening such as the opening 26*c* for a common pad to expose at least a part of the first terminal electrode and a second opening such as the opening 26*d* for an individual pad to expose at least a part of the second terminal electrode. The first opening and the second opening are arranged in an area in which an amount of charges supplied by the discharge electrode becomes a predetermined amount or more when, by corona discharge or glow discharge generated by a discharge electrode arranged to face a surface of the holding substrate provided with the first opening and the second opening, charges are supplied to the first terminal electrode and the second terminal electrode through the first opening and the second opening, respectively, to generate an electric field between the first drive electrode and the second drive electrode to perform polarization processing on the electromechanical transducer.

According to this aspect, as described in the embodiment, the holding substrate having the first opening and the second opening to expose at least the parts of the first terminal electrode and the second terminal electrode is bonded to the substrate provided with the electromechanical transducer, the first terminal electrode, and the second terminal electrode. Then, the discharge processing by the corona discharge or the glow discharge is executed on the surface of the holding substrate provided with the first opening and the second opening. By the discharge processing, the charges with the predetermined polarities and the different amounts of charges are applied to the first drive electrode and the second drive electrode of the electromechanical transducer through the first terminal electrode and the second terminal electrode exposed from the first opening and the second opening, respectively. By the charges, the electric field is generated in the electromechanical transducer interposed by the first drive electrode and the second drive electrode of the electromechanical transducer and the polarization processing can be executed. As such, the polarization processing is executed at a step close to a final step after the holding substrate is bonded to the substrate provided with the electromechanical transducer, the first terminal electrode, and the second terminal electrode, so that depolarization by an influence of a heat history by the following steps can be prevented, and the stabilized polarization processing is enabled. In addition, in the polarization processing by the discharge, a probe card directly contacting the terminal electrode is unnecessary and the polarization processing can be collectively executed on the plurality of electromechanical transducers with a simple configuration. Therefore, a manufacturing cost can be decreased.

In the polarization processing, the charges by the corona discharge or the glow discharge generated by the discharge electrode are supplied to the first terminal electrode and the second terminal electrode through the first opening and the second opening of the holding substrate, respectively. Meanwhile, in the corona discharge or the glow discharge, the intensity of the discharge increases when a distance with the discharge electrode decreases and the intensity of the discharge decreases when the distance with the discharge electrode increases. For this reason, the amount of charges supplied to the first terminal electrode and the second terminal electrode changes according to the arrangement of the first opening and the second opening for the discharge electrode. That is, when the polarization processing of the electromechanical transducer is executed by the discharge processing after bonding of the holding substrate, the arrangement of the first opening and the second opening affects the polarization processing. In the droplet discharge head, the first opening and the second opening are arranged closely to become the area where the amount of charges supplied by the discharge electrode becomes the predetermined amount or more. Thereby, charge of the predetermined amount or more can be supplied to the first opening and the second opening and the superior polarization processing is enabled. Meanwhile, when the first opening and the second opening are apart from each other, charges of the predetermined amount or more cannot be supplied to the first opening or the second opening, charges of an amount necessary for the polarization cannot be supplied to the first terminal electrode or the second terminal, and the polarization does not advance.

As such, the droplet discharge head including the electromechanical transducer that has the superior polarization characteristic while the manufacturing cost is decreased can be provided.

(Aspect B)

In (aspect A), the droplet discharge head further including a plurality of electromechanical transducers; and a second terminal electrode row in which a plurality of second terminal electrodes corresponding to the plurality of electromechanical transducers are arranged in a row. In a Y direction perpendicular to the second terminal electrode row, a distance (distance D1) from a center of the first opening to a center of the second opening is 3000 μm or less and a distance (distance D6) from a center of the first terminal electrode to a center of the second terminal electrode is 3000 μm or less.

According to this aspect, as described in the embodiment, the electromechanical transducers are arranged in parallel to the second terminal electrode row, the discharge processing is executed on the first opening and the second opening of the holding substrate, and the charges are supplied to the first terminal electrode and the second terminal electrode exposed through the individual openings. For this reason, the amount of charges supplied to the first terminal electrode and the second terminal electrode changes according to the arrangement of the first opening and the second opening and the arrangement of the first terminal electrode and the second terminal electrode exposed from the individual openings, in the direction perpendicular to the second terminal electrode row.

In the droplet discharge head, in the direction perpendicular to the second terminal electrode row, the distance (distance D1) from the center of the first opening to the center of the second opening is 3000 μm or less. In addition, the distance (distance D6) from the center of the first terminal electrode to the center of the second terminal electrode is 3000 μm or less. As illustrated in the experiments described above, the distance (distance D1) from the center of the first opening to the center of the second opening and the distance (distance D6) from the center of the first terminal electrode to the center of the second terminal electrode are set in the ranges, the polarization advances, and the electromechanical transducer having the superior polarization characteristic can be obtained.

Meanwhile, if the distance (distance D1) from the center of the first opening to the center of the second opening is beyond the range, it is difficult to supply the charges generated by the discharge to the inner side through the first opening or the second opening. In addition, if the distance (distance D6) from the center of the first terminal electrode to the center of the second terminal electrode is beyond the range, it is difficult to inject the charges into the first terminal electrode or the second terminal electrode, even though the charges are supplied to the inner side through the first opening and the second opening. As illustrated in the experiments described above, if the distance (distance D1) from the center of the first opening to the center of the second opening and the distance (distance D6) from the center of the first terminal electrode to the center of the second terminal electrode are beyond the ranges, the polarization does not advance.

That is, the distance (distance D1) from the center of the first opening to the center of the second opening is 3000 μm or less and the distance (distance D6) from the center of the first terminal electrode to the center of the second terminal electrode is 3000 μm or less, so that the superior polarization processing of the plurality of electromechanical transducers is executed.

(Aspect C)

In (aspect B), a distance from the center of the second terminal electrode such as the individual electrode pad 21 to an end of the second opening such as the opening 26*d* for the individual pad in a horizontal direction, such as a distance (distance D3) in a Y direction and a distance (distance D5) in an X direction, is 250 μm or more.

According to this aspect, as described in the embodiment, the distance from the center of the second terminal electrode and the end of the second opening in the horizontal direction is 250 μm or more, so that the charges are supplied efficiently to the second terminal electrode. For this reason, the superior polarization processing can be executed on the electromechanical transducer. Meanwhile, when the distance from the center of the second terminal electrode and the end of the second opening in the horizontal direction is shorter than a distance in the range and the center of the second terminal electrode and the end of the second opening are excessively close to each other, the amount of charges supplied to the second terminal electrode decreases and efficiency of the polarization processing is deteriorated.

(Aspect D)

In (aspect B) or (aspect C), a distance from the center of the first terminal electrode such as the common electrode pad 19 to an end of the first opening such as the opening 26*c* for the common pad in a horizontal direction, such as a distance (distance D2) in a Y direction and a distance (distance D4) in an X direction, is 250 μm or more.

According to this aspect, as described in the embodiment, the distance from the center of the first terminal electrode to the end of the first opening in the horizontal direction is 250 μm or more, so that the charges are supplied efficiently to the first terminal electrode. For this reason, the superior polarization processing can be executed on the electromechanical transducer. Meanwhile, when the distance from the center of the first terminal electrode to the end of the first opening in the horizontal direction is shorter than a distance in the range and the center of the first terminal electrode and the end of the first opening are excessively close to each other, the amount of charges supplied to the first terminal electrode decreases and efficiency of the polarization processing is deteriorated.

(Aspect E)

In any one of (aspect A) to (aspect D), the second opening is continuously formed to become an opening common to the plurality of second terminal electrodes. According to this aspect, as described in the embodiment, the charges can be supplied efficiently to the plurality of second terminal electrodes through the continuous large opening. In a configuration in which the second opening is commonly used, polarization efficiency is improved as compared with a configuration in which the second opening is provided for each second terminal electrode.

(Aspect F)

In any one of (aspect A) to (aspect E), an area of the first opening is greater than an area of the first terminal electrode. According to this aspect, as described in the embodiment, polarization is easy as compared with the case in which the area of the first opening is narrower than the area of the first terminal electrode.

(Aspect G)

In any one of (aspect A) to (aspect F), an area of the second opening is greater than an area of the second terminal electrode. According to this aspect, as described in the embodiment, polarization is easy as compared with the case in which the area of the second opening is narrower than the area of the second terminal electrode.

(Aspect H)

A polarization processing method of the electromechanical transducer in the droplet discharge head according to any one of (aspect A) to (aspect G) includes causing the holding substrate 26 having the first opening such as the opening 26*c* for the common pad to expose the first terminal electrode such as the common electrode pad 19 and the second opening such as the opening 26*d* for the individual pad to expose the second terminal electrode such as the individual electrode pad 21 to face the discharge electrode such as the corona electrode 71 with a void therebetween, after the holding substrate 26 is provided; and executing discharge processing on at least the first opening and the second opening of the holding substrate, such that charges of different amounts are applied to the first drive electrode and the second drive electrode through the first terminal electrode and the second terminal electrode, respectively, by the discharge electrode.

According to this aspect, as described in the embodiment, the discharge processing by the discharge electrode is executed on the first opening to expose the first terminal electrode and the second opening to expose the second terminal electrode in the holding substrate and the charges are supplied to the first terminal electrode and the second terminal electrode. The charges supplied to the first terminal electrode and the second terminal electrode flow to the first drive electrode and the second drive electrode of the electromechanical transducer and the charges with the predetermined polarities and the different charge amounts are applied to the first drive electrode and the second drive electrode. By the charge application, the polarization processing can be executed on the electromechanical transduction film interposed by the first drive electrode and the second drive electrode of the electromechanical transducer. As such, the polarization processing is executed at a step close to a final step after the holding substrate is bonded to the substrate provided with the electromechanical transducer, the first terminal electrode, and the second terminal electrode, so that depolarization by an influence of a heat history by the following steps can be prevented, and the stabilized polarization processing is enabled. In the polarization processing by the discharge, a probe card directly contacting the terminal electrode is unnecessary and the polarization processing can be collectively executed on the plurality of electromechanical transducers with a simple configuration. Therefore, a manufacturing cost can be decreased.

In addition, because the discharge processing is executed on the first opening and the second opening of the holding substrate, using the discharge electrode, the amount of charges injected into the first terminal electrode and the second terminal electrode changes according to the arrangement of the first opening and the second opening. For this reason, the arrangement of the first opening and the second opening is defined as described above, so that the charges necessary for the polarization processing can be supplied to the first terminal electrode and the second terminal electrode. Therefore, the superior polarization processing of the electromechanical transducer is executed.

As such, the superior polarization processing can be executed on the electromechanical transducer while the manufacturing cost is decreased.

(Aspect I)

Aspect I relates to a method of manufacturing a droplet discharge head that includes a nozzle such as the nozzle 11 to discharge droplets; a liquid chamber such as the liquid chamber 13 communicated with the nozzle; an electromechanical transducer such as a piezoelectric element such as the piezoelectric element 16 provided on a substrate such as the substrate 14 to pressurize a liquid in the liquid chamber, the electromechanical transducer including a first drive electrode such as the common electrode 161 at a first side facing the substrate and a second drive electrode such as the individual electrode 163 at a second side opposite to the first side; a first terminal electrode such as the common electrode pad 19 connected to the first drive electrode such as the common electrode 161; a second terminal electrode such as the individual electrode pad 21 connected to the second drive electrode such as the individual electrode 163; and a holding substrate such as the holding substrate 26 covering the electromechanical transducer. The method includes providing the electromechanical transducer on the substrate; forming the first terminal electrode and the second terminal electrode; providing the holding substrate; and executing the polarization processing according to (aspect H).

According to this aspect, as described in the embodiment, the droplet discharge head including the electromechanical transducer that has the superior polarization characteristic can be manufactured while the manufacturing cost is decreased.

(Aspect J)

An image forming apparatus such as the inkjet recording apparatus 100 includes the droplet discharge head according to any one of (aspect A) to (aspect H).

According to this aspect, an image quality can be improved while a manufacturing cost of the image forming apparatus is suppressed.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A droplet discharge head, comprising:

a substrate including a liquid chamber communicated with a nozzle to discharge droplets;

an electromechanical transducer provided on the substrate to pressurize a liquid in the liquid chamber, the electromechanical transducer including a first drive electrode at a first side facing the substrate and a second drive electrode at a second side opposite to the first side;

a first terminal electrode connected to the first drive electrode;

a second terminal electrode connected to the second drive electrode; and a holding substrate covering the electromechanical transducer to be displaceable, wherein the holding substrate has a first opening to expose at least a part of the first terminal electrode and a second opening to expose at least a part of the second terminal electrode, and the first opening and the second opening are arranged in an area in which an amount of charges supplied by a discharge electrode becomes a threshold amount or more when, by corona discharge or glow discharge generated by the discharge electrode arranged to face a surface of the holding substrate having the first opening and the second opening, charges are supplied to the first terminal electrode and the second terminal electrode through the first opening and the second opening to generate an electric field between the first drive electrode and the second drive electrode to perform polarization processing on the electromechanical transducer.

2. The droplet discharge head according to claim 1, further comprising:

a plurality of electromechanical transducers; and a second terminal electrode row in which a plurality of second terminal electrodes corresponding to the plurality of electromechanical transducers are arranged in a row, wherein, in a direction perpendicular to the second terminal electrode row, a distance from a center of the first opening to a center of the second opening is 3000 μm or less and a distance from a center of the first terminal electrode to a center of the second terminal electrode is 3000 μm or less.

3. The droplet discharge head according to claim 2, wherein a distance from the center of the second terminal electrode to an end of the second opening in a horizontal direction is 250 μm or more.

4. The droplet discharge head according to claim 2, wherein a distance from the center of the first terminal electrode to an end of the first opening in a horizontal direction is 250 μm or more.

5. The droplet discharge head according to claim 2, wherein the second opening is continuously formed to be an opening common to the plurality of second terminal electrodes.

6. The droplet discharge head according to claim 1, wherein an area of the first opening is greater than an area of the first terminal electrode.

7. The droplet discharge head according to claim 1, wherein an area of the second opening is greater than an area of the second terminal electrode.

8. A polarization processing method of the electromechanical transducer in the droplet discharge head according to claim 1, the polarization processing method comprising:

causing the holding substrate having the first opening to expose the first terminal electrode and the second opening to expose the second terminal electrode to face the discharge electrode with a void therebetween, after the holding substrate is provided; and executing discharge processing on at least the first opening and the second opening of the holding substrate such that charges of different amounts are applied to the first drive electrode and the second drive electrode through the first terminal electrode and the second terminal electrode by the discharge electrode.

9. A method of manufacturing the droplet discharge head according to claim 1, the method comprising:

providing the electromechanical transducer on the substrate;

forming the first terminal electrode and the second terminal electrode;

providing the holding substrate; and executing a polarization processing including causing the holding substrate having the first opening to expose the first terminal electrode and the second opening to expose the second terminal electrode to face the discharge electrode with a void therebetween, after the holding substrate is provided, and executing discharge processing on at least the first opening and the second opening of the holding substrate such that charges of different amounts are applied to the first drive electrode and the second drive electrode through the first terminal electrode and the second terminal electrode by the discharge electrode.

10. An image forming apparatus comprising the droplet discharge head according to claim 1.

* * * * *